US007847809B2

(12) United States Patent
Inazumi

(10) Patent No.: US 7,847,809 B2
(45) Date of Patent: Dec. 7, 2010

(54) IMAGE DISPLAY METHOD, IMAGE DISPLAY PROCESSING PROGRAM, AND IMAGE DISPLAY APPARATUS

(75) Inventor: Mitsuhiro Inazumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 863 days.

(21) Appl. No.: 11/358,000

(22) Filed: Feb. 22, 2006

(65) Prior Publication Data

US 2006/0192792 A1 Aug. 31, 2006

(30) Foreign Application Priority Data

Feb. 28, 2005 (JP) ..... 2005-052610

(51) Int. Cl.
*G09G 5/10* (2006.01)
*G09G 3/36* (2006.01)

(52) U.S. Cl. ..... 345/690; 345/89

(58) Field of Classification Search ..... 345/690–693, 345/87–100; 340/815.55; 358/1.9–3.32; 382/145–149

See application file for complete search history.

(56) References Cited

U.S. PATENT DOCUMENTS 5,134,487 A * 7/1992 Taguchi et al. ..... 348/384.1
6,831,621 B2 * 12/2004 Nakano ..... 345/87
2001/0017604 A1 * 8/2001 Jacobsen et al. ..... 345/27
2003/0193463 A1 * 10/2003 Yamada et al. ..... 345/88
2004/0008215 A1 * 1/2004 Shimizu et al. ..... 345/690
2005/0162360 A1 * 7/2005 Ishihara et al. ..... 345/89
2007/0058088 A1 * 3/2007 Schubert et al. ..... 348/743

FOREIGN PATENT DOCUMENTS

JP A 08-248381 9/1996
JP 2003241714 A * 8/2003
JP A 2003-280614 10/2003
WO WO 2004/003884 A1 1/2004
WO WO 2004/102245 A1 * 11/2004

OTHER PUBLICATIONS

Machine translations of Japanese Publications JP2003-241714, JP2003-280614, JP8-248381.*

* cited by examiner

*Primary Examiner*—Amr Awad
*Assistant Examiner*—Liliana Cerullo
(74) *Attorney, Agent, or Firm*—Oliff & Berridge, PLC

(57) ABSTRACT

In an image display method for providing display in a predetermined color order using a plurality of color signals of image data for an electro-optical modulation device which modulates light emitted from a light source in accordance with signals, color distribution ratios for the plural color signals are established such that errors caused due to response delays of the electro-optical modulation device from the color signals can be reduced to the minimum value or almost the minimum value at the time of display in the predetermined color order.

8 Claims, 24 Drawing Sheets

RELATED ART

RELATED ART

IMAGE DISPLAY METHOD, IMAGE DISPLAY PROCESSING PROGRAM, AND IMAGE DISPLAY APPARATUS

BACKGROUND

1. Technical Field

The present invention relates to an image display method, an image display processing program, and an image display apparatus capable of performing color sequential display.

2. Related Art

Color image data is represented as a collection of a small number of color signals. In most cases, the data is represented using three primary color data of red (R), green (G) and blue (B) as reference colors. For actual display, cyan (C), magenta (M) and yellow (Y) as complementary colors of the reference colors R, G and B and other colors are used in some cases.

For displaying color images using these plural color signals, there are currently a color simultaneous display method which displays all color signals simultaneously, and a color sequential display method which displays respective color signals in a time-sequential manner.

In the color simultaneous display method, the respective colors are placed side by side or overlapped with one another in a space to be simultaneously displayed. This method provides natural display, but requires a complicated display apparatus. In a liquid crystal display panel or a plasma display, for example, respective R, G and B display elements need to be arranged extremely minutely. In the case of a projection-type display apparatus such as a projector, three light modulation elements (called electro-optical modulation devices) for producing respective R, G and B images and a synthesizing section for accurately overlapping these three single-color images into one full-color image need to be equipped.

On the other hand, the color sequential display method disposes the respective colors in a time-sequential manner for sequential display. Since only a single color image is displayed at a certain moment, only one electro-optical modulation device is required. Thus, the display apparatus can be relatively simplified and miniaturized.

The color sequential display method can be practiced because the human vision has an integral characteristic for the time constant of several ten seconds. More specifically, images sequentially displayed within this time constant are recognized not as separate images but as images of mixed colors to the human eyes, and the color sequential display method utilizes this characteristic. Thus, when the respective R, G and B images are switched to one another at high speed during display, these images are recognized as full-color images produced by the three color signals R, G and B.

Accordingly, the color sequential display method is advantageous in view of simplification and miniaturization of the system and cost reduction compared with the color simultaneous display method. However, in exchange for the advantages, the color sequential display method has drawbacks such as color splits in display and a problem of response performance of the electro-optical modulation device, which do not occur in the color simultaneous display method.

Color splits in display are caused when the respective images are not accurately overlapped with one another on the retina in the color sequential display method. Thus, the color sequential display method is practiced on the assumption that the single-color images arranged in the time-sequential manner are accurately overlapped on the retina.

However, when the vision is shifted during the color sequential display, i.e., when images on the retina are moved to another position, the images are not correctly overlapped and thus the respective color signals of the original images are separately recognized. This phenomenon is called color splits, which cause severe deterioration in image quality.

The problem of response performance of the electro-optical modulation device is caused due to shortened display time of the single-color images resulting from time-sequential arrangement of the images.

More specifically, a digital-type electro-optical modulating device such as a digital mirror device (DMD: registered trademark) requires a certain period of display time to be secured since it shows gradations by such a method as pulse width modulation. For highly accurate display within a short display time, the DMD needs to perform high-speed processing, which leads to higher power consumption, shorter life, unnecessary electromagnetic radiation and other problems.

Additionally, an analog-type electro-optical modulation device such as a liquid crystal display element requires a certain time period for obtaining outputs in correspondence with inputs.

FIG. 25 schematically shows a thin film transistor (TFT) type liquid crystal display device as an example of the electro-optical modulation device. The TFT type liquid crystal display device has TFTs 101 provided on a board by a thin film technique, liquid crystal cells 102, and retention capacitors 103 in correspondence with respective display elements, and signal lines (gate lines 104 and source lines 105) through which signals are supplied. As illustrated in the figure, the liquid crystal cells 102 are considered as capacitors from the viewpoint of electric circuit. Thus, the conditions of the liquid crystals vary in accordance with the voltage charged to the liquid crystal cells 102, thereby changing the polarization conditions of light which passes through the liquid crystal cells 102 for display.

The light modulation outputs from the liquid crystal display device are variable in accordance with the voltage charged to the capacitors (liquid crystal cells 102). Thus, display response delay is caused in correspondence with delay of charge to the capacitors. More specifically, the response time of the currently used high-speed liquid crystal display device is as long as several milliseconds. This time period is almost equal to 6 milliseconds as the display time of 180 sub frames per second when images of 60 frames per second are displayed in the time-sequential manner using the three primary colors of R, G and B, for example. Therefore, the response time cannot be ignored at all.

A related art which reduces color splits and solves the problem of response time has been disclosed in JP-A-8-248381. According to this technique, the color order of R, G and B for color sequential display is switched on the cycle of three frames, such as RGB, BRG, and GRB, as shown in FIG. 16 and other figures attached to the specification of the reference.

FIG. 26 shows a color order for color sequential display according to JP-A-8-248381. As illustrated in FIG. 26, colors can be switched by turning on and off the respective R, G and B light sources in this method. Alternatively, colors can be switched using a color wheel divided into 9 parts. As apparent from FIG. 26, lights emitted from the respective light sources R, G and B do not overlap with one another at any time in the color order of the method according to JP-A-8-248381.

Since the color order shown in FIG. 26 is used in the method of JP-A-8-248381, the same colors are displayed on the boundary between the adjoining frames. As a result, the display time of these colors is increased to twice. Accordingly, the electro-optical modulation device obtains longer response time. Additionally, the colors of R, G and B are equally disposed in the respective sub-frames on the three-frame cycle in this method. As a result, it is expected that R, G and B can be equally mixed in an image having color splits and that deterioration in image quality due to color splits can be thus reduced.

JP-A-2003-280614 is another related art which gives particular attention to the reduction of color splits. According to this technique, the six color system constituted by not only the three primary colors of R, G and B but also cyan (C), magenta (M) and yellow (Y) as complementary colors of R, G and B is used for display.

FIG. 27 shows the color order in color sequential display according to the method disclosed in JP-A-2003-280614. In this method, each frame is divided into 6 sub frames, and colors of Y, B, M, G, C and R are allocated to the respective sub frames one for each. These six colors can be provided using the three R, G and B light sources. In this case, the complementary colors C, M and Y in the sub frames corresponding to the complementary colors C, M and Y can be obtained by using lights emitted from the two light sources. According to JP-A-2003-280614, it is recommended that the intensity of light emitted from the respective light sources in the sub frames of complementary colors is reduced to half so that the overall intensity of light in the sub frames corresponding to the reference colors R, G and B and in the sub frames corresponding to the complementary colors C, M and Y can be equalized.

According to the method disclosed in JP-A-2003-280614, therefore, the width of color splits can be reduced by using the six color system for display, and image quality can be improved by mixing primary colors and complementary colors disposed adjacent thereto in a space in the color order shown in FIG. 27 for display.

Additionally, according to the description in JP-A-2003-280614, the complementary colors are disposed at the same sub frame positions for every two frames. This positioning allows mixing of colors in consideration of time as well as in consideration of space.

According to the technique disclosed in JP-A-8-248381, color splits cannot be sufficiently reduced and the problem of response performance (response delay) cannot be sufficiently solved. More specifically, even if the colors of R, G and B are equally disposed at the same sub frame positions on the three-frame cycle in the method of JP-A-8-248381, this cycle is too long considering the time constant for the human vision characteristic. This problem is clarified as a problem to be solved in the method of JP-A-8-248381 in the specification of JP-A-2003-280614. Since the three-frame cycle of image data having 60 frames per second is 20 cycles per second, one cycle is 50 milliseconds. This period is too long compared with the time constant for the human vision.

As for the problem of response time in the method of JP-A-8-248381, the same color display continues only on the boundary of the frames as illustrated in FIG. 26. Thus, the effect of successive display of the same color is not given to other parts.

On the other hand, the method disclosed in JP-A-2003-280614 can reduce color splits to a significant extent. However, according to this technique, a larger problem concerning response delay of the electro-optical modulation device than the problem in the method of JP-A-8-248381 may be caused. Since one frame is constituted by six sub frames in the method of JP-A-2003-280614, the display time of one sub frame is half of that in the method of JP-A-8-248381 which has three sub frames in one frame. This is not a serious problem if the response time of the electro-optical modulation device is sufficiently short in accordance with this time reduction. However, in the currently used electro-optical modulation device, this requirement is not sufficiently satisfied.

Therefore, both techniques disclosed in JP-A-8-248381 and JP-A-2003-280614 are not optimum methods which can sufficiently solve the problems particularly concerning the response performance of the electro-optical modulation device.

SUMMARY

Accordingly, an advantage of some aspects of the invention is to provide an image display method, an image display processing program, and an image display apparatus, capable of improving display accuracy by appropriately color-distributing color signals considering response performance of an electro-optical modulation device for image display based on color sequential display.

(1) An image display method according to a first aspect of the invention is an image display method for providing display in a predetermined color order using a plurality of color signals of image data for an electro-optical modulation device which modulates light emitted from a light source in accordance with signals, wherein color distribution ratios for the plural color signals are established such that errors caused due to response delays of the electro-optical modulation device from the color signals can be reduced to the minimum value or almost the minimum value at the time of display in the predetermined color order.

In this case, the errors caused due to the response delays of the electro-optical modulation device from the color signals can be reduced to the minimum value or almost the minimum value by appropriately distributing colors considering the response delays of the electro-optical modulation device. Thus, the display accuracy which is lowered due to the response delays of the electro-optical modulation device can be improved, and highly accurate display can be obtained even when a display device providing relatively low-speed response is used.

(2) In the image display method according to (1), it is preferable that the plural color signals include N reference colors (N: 3 or larger integer) and N complementary colors of the N reference colors, and that the color order including the N reference colors and N complementary colors is such a color order that the N reference colors and N complementary colors are alternately allocated in a predetermined color order or a reversed color order in 2N sub frames of one frame which includes the N reference colors and the N complementary colors.

In this case, the image display method according to the first aspect of the invention can be applied in both cases when only the N reference colors are used and when 2N color system including the N complementary colors as well as the N reference colors is used, for example. In case of the 2N color system, great advantages can be offered concerning color splits.

(3) In the image display method according to (1), it is preferable that the volumes of errors caused due to response delays of the electro-optical modulation device from the color signals are determined based on quantities in variation in the plural color signals which are given to the electro-optical modulation device at the time of display in the color order in each frame.

In this case, the errors caused due to response delays of the electro-optical modulation device from the color signals can be quantitatively evaluated, and thus the volumes of the errors can be appropriately determined.

(4) In the image display method according (3), it is preferable that the quantities of variation in the plural signals are obtained by integrating the absolute values of quantities of variation in the respective color signals.

In this case, the quantities of variation in the plural color signals can be appropriately obtained by simplified calculation, and the obtained quantities of variation appropriately represent the volumes of the errors caused due to the response delays of the electro-optical modulation device from the color signals.

(5) In the image display method according to (3), it is preferable that the quantities of variation in the plural signals are calculated by: dividing a plurality of colors of lights, which are emitted from respective light-emitting units for emitting lights of the N reference colors, into a plurality of groups allowing overlaps; calculating an integral value of quantities of variation in the color signals for each color contained in each group; and adding the absolute values of the integral values obtained for the respective groups to calculate the quantities of variation in the plural signals.

In this case, the quantities of variation in the plural color signals can be appropriately obtained by simplified calculation, and the obtained quantities of variation appropriately represent the volumes of the errors caused due to the response delays of the electro-optical modulation device from the color signals, similarly to the image display method in (4).

(6) In the image display method according to (5), it is preferable that weights according to the levels of visual sensitivity of the human eyes to colors are given to the integral values of the quantities of variation obtained for the respective groups.

Since the weights according to the levels of visual sensitivity of the human eyes to colors are given to the quantities of variation, the quantities of variation obtained are values obtained considering the levels of visual sensitivity of the human eyes. Accordingly, colors are more appropriately distributed and thus display with higher accuracy can be provided.

(7) In the image display method according to (2), it is preferable that the color order is any one of the color orders of: R, Y, G, C, B and M; Y, G, C, B, M and R; G, C, B, M, R and Y; C, B, M, R, Y and G; B, M, R, Y, G and C; M, R, Y, G, C and B; R, M, B, C, G and Y; M, B, C, G, Y and R; B, C, G, Y, R and M; C, G, Y, R, M and B; G, Y, R, M, B and C; and Y, R, M, B, C and G when the N reference colors are R (red), G (green) and B (blue) and the N complementary colors are C (cyan), M (magenta) and Y (yellow).

In this case, more correlated colors are successively positioned in these color orders, and variations in signals given to the electro-optical modulation device can be further reduced in the color sequential display in these color orders. Accordingly, the errors caused due to response delays of the electro-optical modulation device from the color signals can be further decreased, and highly accurate display can be obtained even when a display device providing relatively low-speed responses is used.

(8) In the image display method according to (1), it is preferable that the color order of one of successive two frames as one unit in the image data is reversed.

In this case, the color order of one of the two frames as one unit is reversed. Thus, the quantity of variation in the color signals on the boundary between successive frames can be decreased to zero even when large signal variation is produced on the frame boundary.

(9) In the image display method according to (8), when it is determined that a widely distributed color signal is positioned in the middle or around the middle sub frame of the plural sub frames contained in a frame by the judgment of color distribution of the frame in the image data, it is preferable that the color order is changed such that the sub frame corresponding to the widely distributed color signal can be positioned on the boundary between the successive two frames.

This is an improvement over the image display method in (8), and the widely distributed color signal is shifted to the frame boundary when this color signal is positioned in the middle or around the middle of the frame. By this method, advantages equivalent to those in (8) can be obtained. In the image display method shown in (9), since the color distributions for the respective frames are judged and the color orders are established according to the judged color distributions, the errors caused due to response delays of the electro-optical modulation device can be reduced in accordance with data to be displayed.

(10) An image display processing program according to a second aspect of the invention is an image display processing program for providing display in a predetermined color order using a plurality of color signals of image data for an electro-optical modulation device which modulates light emitted from a light source in accordance with signals, capable of performing processing for establishing color distribution ratios for the plural color signals such that errors caused due to response delays of the electro-optical modulation device from the color signals can be reduced to the minimum value or almost the minimum value at the time of display in the predetermined color order.

In the image display processing program according to (10), advantages similar to those in the image display method according to (1) can be offered. It is preferable that the image display processing program according to (10) has characteristics similar to those in the image display method according to (2) through (9).

(11) An image display apparatus according to a third aspect of the invention is an image display processing program for providing display in a predetermined color order using a plurality of color signals of image data for an electro-optical modulation device which modulates light emitted from a light source in accordance with signals, comprising a color distribution ratio setting section for establishing color distribution ratios for the plural color signals such that errors caused due to response delays of the electro-optical modulation device from the color signals can be reduced to the minimum value or almost the minimum value at the time of display in the predetermined color order.

In the image display apparatus according to (11), advantages similar to those in the image display method according to (1) can be offered. It is preferable that the image display apparatus according to (11) has characteristics similar to those in the image display method according to (2) through (9).

BRIEF DESCRIPTION OF THE DRAWINGS

The invention will be described with reference to the accompanying drawings, wherein like numbers refer to like elements.

DESCRIPTION OF EXEMPLARY EMBODIMENTS

Several embodiments according to the invention will be hereinafter described in detail.

First Embodiment

Figure 1:
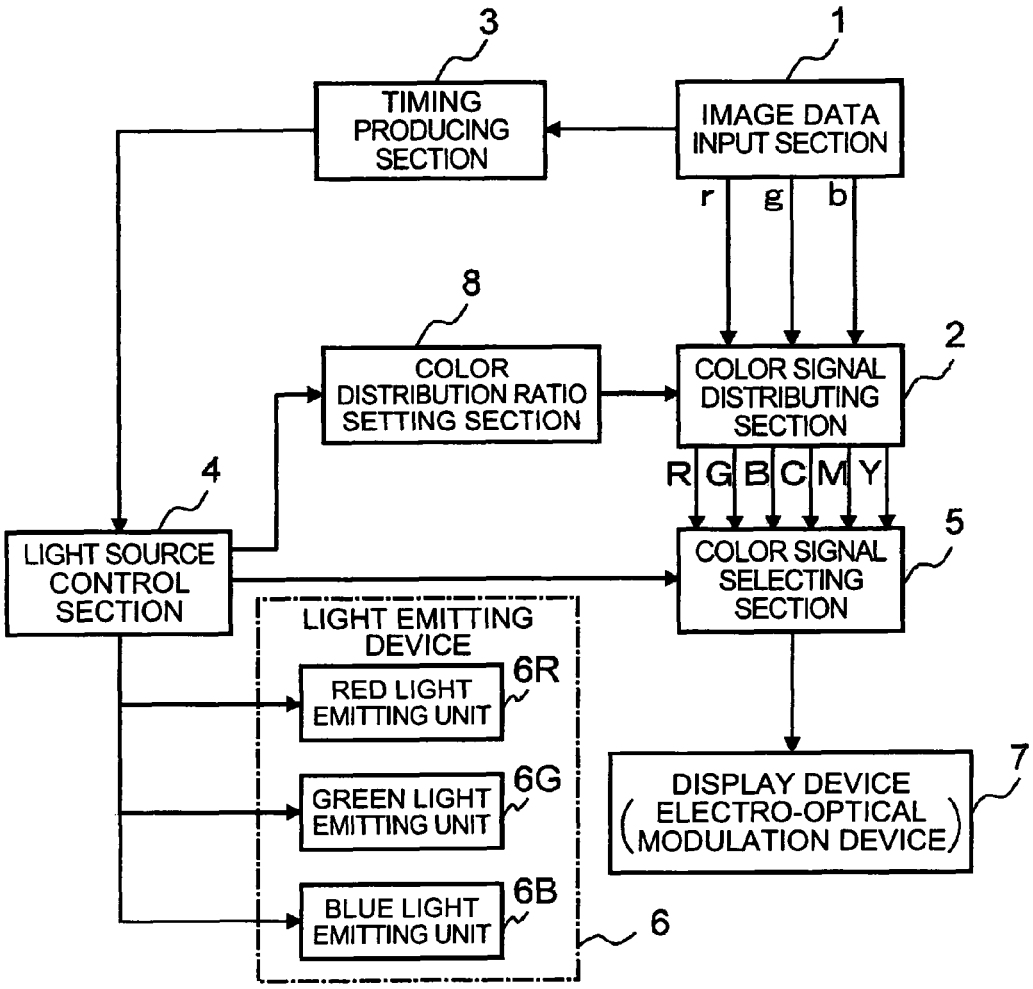
FIG. 1 illustrates a structure of an image display apparatus in a first embodiment.

FIG. 1 illustrates a structure of an image display apparatus in a first embodiment according to the invention. The image display apparatus in the first embodiment includes an image data input section 1, a color signal distributing section 2, a timing producing section 3, a light source control section 4, a color signal selecting section 5, a light emitting device 6 as a light source, an electro-optical modulation device 7 as a display device, and a color distribution ratio setting section 8 for setting distribution ratios of color signals.

In the respective embodiments according to the invention, the reference colors are R, G and B and the complementary colors of the reference colors are C, M and Y, and a transmissive-type liquid crystal display device is used as the electro-optical modulation device 7. Since the reference colors are R, G and B, the light emitting device 6 has a red (R) color light emitting unit 6R, a green (G) color light emitting unit 6G, and a blue (B) color light emitting unit 6B, each of which units is formed by an LED, for example.

In the respective embodiments according to the invention, it is assumed that image data inputted from the image data input section 1 is outputted as signals r, g and b. Actually, signals Y, U and V, signals Y, Pb and Pr and other signals may be used in some cases, but only signals r, g and b are used herein since the difference produced therefrom is not essential in the description of the invention.

In the respective embodiments according to the invention, it is assumed that color sequential display is performed using the six color system which is constituted by the reference colors R, G and B and also colors C, M and Y as complementary colors of those similarly to the method disclosed in JP-A-2003-280614. Color signals for six-color indication distributed to the reference colors R, G and B and the complementary colors C, M and Y are represented as signals R, G and B and signals C, M and Y, respectively. The color signals R, G, B, C, M and Y are produced by the color signal distributing section 2 as illustrated in FIG. 1. The color signal distributing section 2 is controlled by the color distribution ratio setting section 8. The color distribution ratio setting section 8 is controlled by the light source control section 4 for controlling the color order for color sequential display.

The light source control section 4 controls the red color light emitting unit 6R, the green color light emitting unit 6G and the blue color light emitting unit 6B in synchronization with the timing produced by the timing producing section 3 operated based on display time control information included in the image data. By this control, color sequential display providing the six color system sequential display is performed. The color signal selecting section 5 selects appropriate color signals from the signals R, G, B, C, M and Y based on the control by the light source control section 4.

Figure 2:
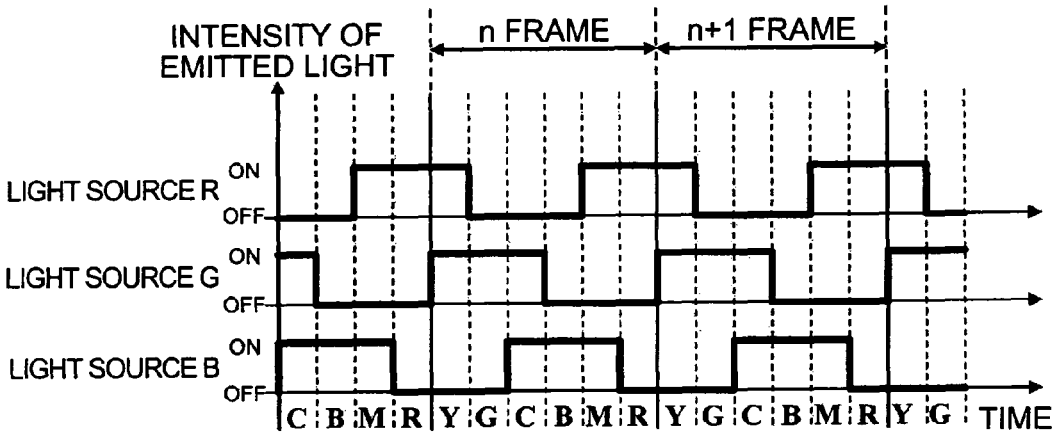
FIG. 2 is a time-chart showing a color order and ON timing of light sources R, G and B in the first embodiment.

FIG. 2 shows the color order and ON-timing of he respective light sources R, G and B (red color light emitting unit 6R, green color light emitting unit 6G and blue color light emitting unit 6B) used in the respective embodiments according to the invention. While six color system constituted by the reference colors R, G and B and the complementary colors C, M, and Y are used similarly to the method of JP-A-2003-280614, the respective light sources R, G and B are simply ON/OFF controlled as shown in FIG. 2 in the respective embodiments and the intensity of emitted lights are not varied as in the method of JP-A-2003-280614 shown in FIG. 27.

Figure 27:
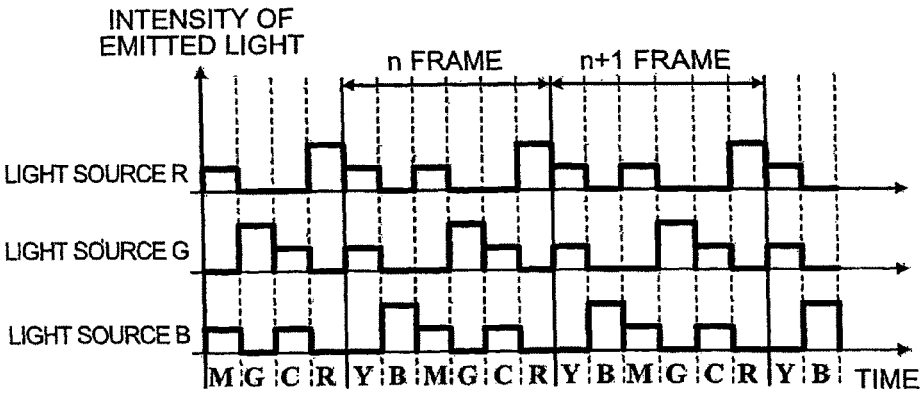
FIG. 27 shows a color order for color sequential display shown in JP-A-2003-280614.

In the respective embodiments, the R, G and B light sources are not controlled for each sub frame as in the method of JP-A-2003-280614 shown in FIG. 27, but the R, G and B light sources only repeat simple ON/OFF switching with duty cycle of 50% and produce six sub frames by shifting their phases. As a result, the number of times of ON/OFF switching executed by the respective light sources is decreased to half of that number in the method of JP-A-2003-280614. Thus, the power loss caused by the ON/OFF switching can be reduced to half.

Generally, light sources consume a large amount of power, and the switching operation is a major burden for control elements. The switching control also causes large electromagnetic radiation noises. Thus, decrease in the number of times of switching control of the light sources offers great advantages in view of noise reduction as well as power consumption reduction.

For providing more preferable advantages according to the invention, it is preferable to perform color sequential display in the color order shown in FIG. 2. In FIG. 2, the color order in each frame is Y, G, C, B, M and R. The method of setting this color order is now explained.

Figure 3:
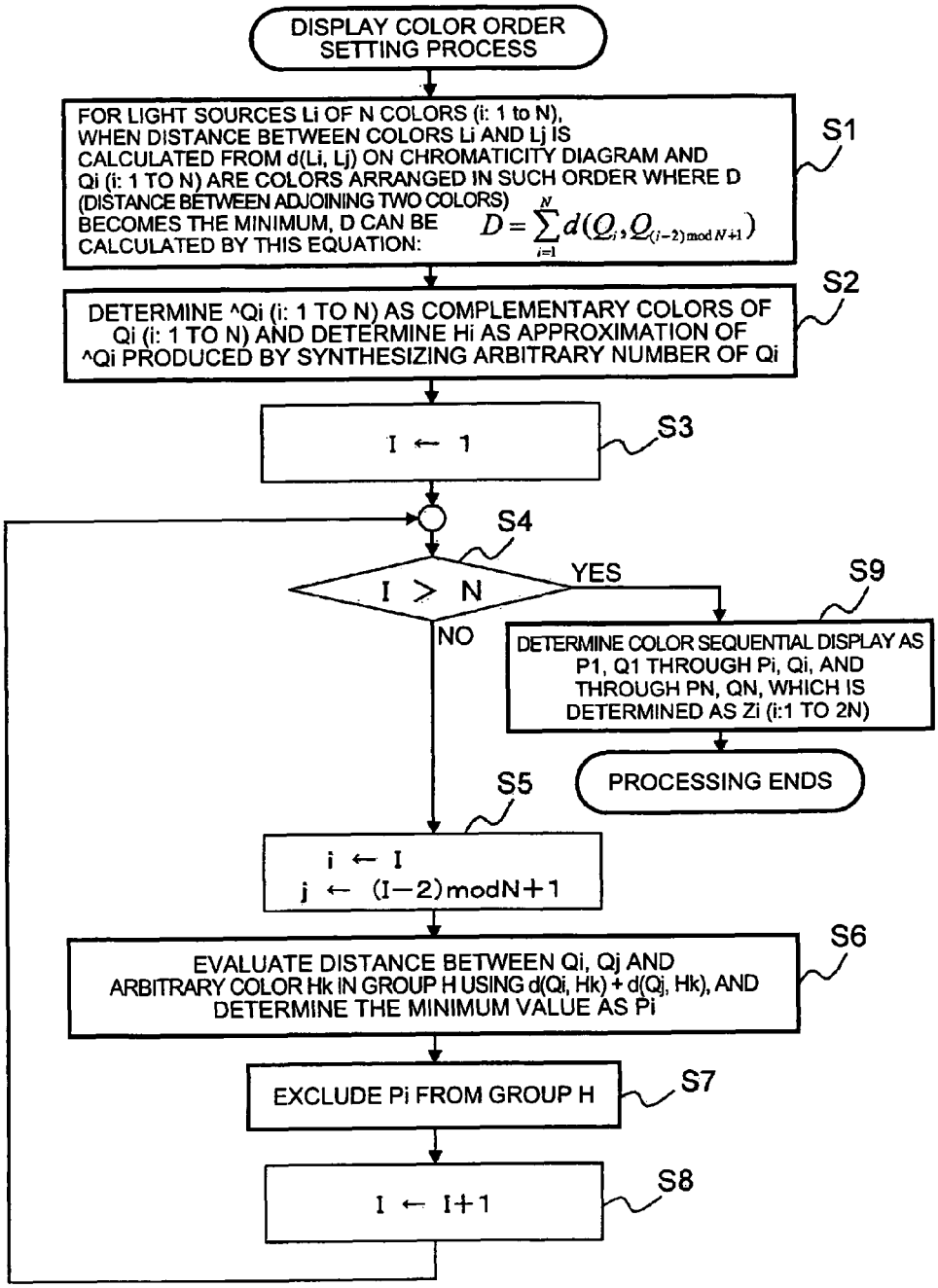
FIG. 3 is a flowchart showing a method for obtaining a color order for color sequential display using N reference colors (N: 3 or larger integer) and complementary colors thereof on a chromaticity diagram (x-y chromaticity diagram).
Figure 4:
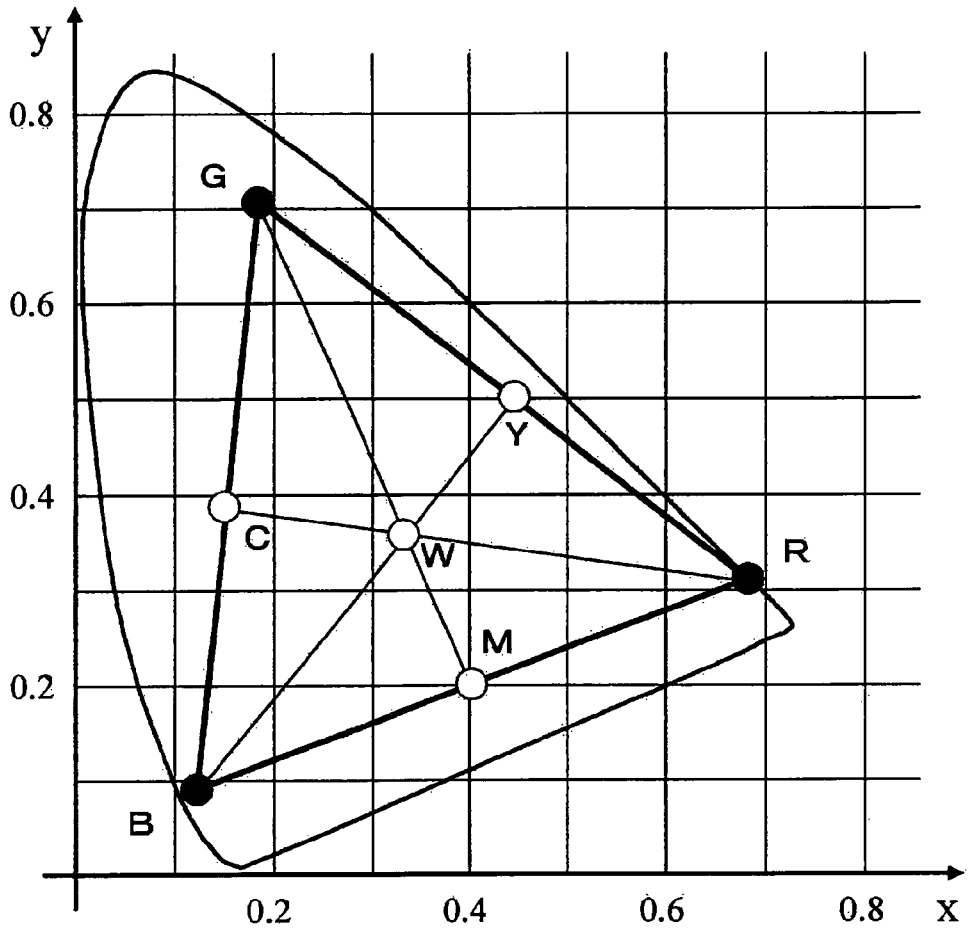
FIG. 4 shows an x-y chromaticity diagram.

FIG. 3 is a flowchart showing a method of obtaining a color order for color sequential display using N reference colors (N: 3 or larger integer) and the complementary colors thereof on a chromaticity diagram (x-y chromaticity diagram), and FIG. 4 shows an x-y chromaticity diagram.

As mentioned above, examples of color sequential display executed using the six color system constituted by colors of R, G and B and colors C, M and Y as the complementary colors are explained in the respective embodiments according to the invention. However, the flowchart in FIG. 3 shows an example of processing for obtaining a color order when N reference colors (N: 3 or larger integer) are used.

As shown in FIG. 3, steps S1 through S8 are carried out to obtain a color order for color sequential display (step S9). The color order for the color sequential display is Zi (i: 1 to 2N) which is P1, Q1, through Pi, Qi, and through PN, QN.

The processing of steps S1 through S9 is generally constituted by: a first step for disposing the N reference colors in such an order that the length of the line starting from a certain starting point reference color of the N reference colors, passing through the reference colors other than the starting point reference color once for each, and returning to the starting point reference color becomes the minimum; a second step for setting the N complementary colors for the N reference colors disposed in this color order; and a third step for selecting a complementary color, which is closest to each adjoining pair of reference colors of the N reference colors arranged in the color order, from the complementary colors established in the second step, and then inserting the selected respective complementary colors between the corresponding adjoining pairs of the reference colors as a color order so as to alternately dispose the respective N reference colors and the respective N complementary colors one by one and establish the obtained order as the color order for the color sequential display on the x-y chromaticity diagram shown in FIG. 4.

Step S1 in FIG. 3 substantially corresponds to the first step. In step S1 in FIG. 3, various functions d (Li, Lj) for calculating the distance between a certain reference color Li (i: 1 to N) and a certain reference color Lj can be employed. For example, the following function can be employed using the coordinates of Li (Xi, Yi) on the x-y chromaticity diagram and the coordinates of Lj (Xj, Yj) on the x-y chromaticity diagram:

$$d(Li,Lj)=(Xi-Xj)^2+(Yi=Yj)^2 \quad (1)$$

The reference colors disposed in the color order obtained in step S1 are now represented as Qi.

Step S2 substantially corresponds to the second step. The N complementary colors established in step S2 are now set as Hi (i: 1 to N). Hi is a synthetic of an arbitrary number of Qi as an approximation of $^{\cap}$Qi when $^{\cap}$Qi is complementary colors of Qi.

Steps S3 through S9 in FIG. 3 substantially correspond to the third step. In steps S3 through S8 out of steps S3 through S9, a complementary color closest to each adjoining pair of the reference colors in the reference colors Ci disposed according to step S1 is selected and the selected respective complementary colors are inserted between the corresponding adjoining pairs of the reference colors as a color order. For selecting a complementary color closest to each adjoining pair of the reference colors, the distance from the adjoining two reference colors to an arbitrary complementary color Hk of the N complementary colors is evaluated.

For evaluating the distance, the complementary color having the minimum value of d(Ci, Hk)+d(Cj, Hk) is selected from the N complementary colors. The selected complementary color Pi is inserted between the corresponding adjoining two reference colors as the color order.

Then, the selected complementary color is excluded (step S7). Thereafter, I+1 is substituted for I, and the same processing is carried out placing i in lieu of I. By repeating this processing until I reaches N, the color order Zi of P1, Q1 through Pi, Qi, and through PN, QN for the color sequential display can be obtained in step S9.

The Nth complementary color PN can be obtained as the remaining one complementary color after the processing of steps S3 through S8 is repeated N−1 times.

The flowchart in FIG. 3 shows the method for obtaining the color display order of N reference colors. A specific example method of producing color order when N=3 and the reference colors emitted from the light emitting device 6 as the light source are R, G and B is now briefly described.

Initially, N colors Li (i: 1 to N) for producing color images are determined as reference colors. Then, a line which starts from a starting point reference color arbitrarily selected, passes through the rest of N−1 colors once for each, and returns to the starting point reference color and which line has the minimum integrated length is selected on the x-y chromaticity diagram shown in FIG. 4. Colors Li disposed in such an order that the line passes therethrough are represented as Qi (i: 1 to N). As apparent from this definition, the reverse order is equivalent. Since the three reference colors of R, G and B (N=3) are used in this example, the order is obvious. For example, when R is the starting point, the order is either R, G and B or R, B and G.

Next, the colors $^{\cap}$Qi as the complementary colors of Qi are obtained. Hi (i: 1 to N) is an approximation of $^{\cap}$Qi obtained by subtracting Qi from Qj (j: 1 to N). Since the three reference colors of R, G and B are used, Hi is C, M and Y as apparent from the x-y chromaticity diagram shown in FIG. 4. C, M, and Y can be represented by G+B, R+B, and R+G, respectively.

Subsequently, a complementary color which is closest to an adjoining pair of the reference colors is selected and represented as Pi. Pi is then excluded from the group of complementary colors (step S6 and S7), and the same process is repeated for each of the remaining complementary colors. As a result, Y is determined as the complementary color for R and G, C is determined as the complementary color for G and B, and M is determined as the complementary color for B and R when the reference colors are R, G and B.

Colors Ci and Cj in step S6 are an adjoining pair of reference colors. The value j is calculated from the equation j=(I−2)modN+1 when i=1 in step S5. Since the three reference colors R, G and B (N=3) are used, the value i is any one of I=1, 2 and 3.

When R=1, G=2, and B=3 on the x-y chromaticity diagram shown in FIG. 4 and i is I=1, j is 3 as calculated from the equation j=(1-2)mod 3+1. This indicates that the adjoining pair of the reference colors Ci and Cj are R and B. When i is I=2, j is 1 as calculated from the equation j=(2-2)mod 3+1. This indicates that the adjoining pair of the reference colors Ci and Cj are G and R. When i is I=3, j is 2 as calculated from the equation j=(3-2)mod 3+1. This indicates that the adjoining pair of the reference colors Ci and Cj are B and G.

By this method, the color display order of P1, Q1, P2, Q2, P3, and Q3 is established from the results thus obtained. The order of Q1, Q2, and Q3 is a clockwise (or anti-clockwise) rotation starting from an arbitrary reference color along the triangle of R, G and B on the x-y chromaticity diagram shown in FIG. 4. For example, when Q1 is G and the rotation is anti-clockwise, Q1, Q2 and Q3 are G, B and R, respectively. When Q1 is G and rotation is anti-clockwise similarly, P1, P2 and P3 are Y, C and M, respectively, assuming that the starting point is Y. Thus, the color order P1, Q1, P2, Q2, P3, Q3 is represented as Y, G, C, B, M and R on the x-y chromaticity diagram shown in FIG. 4.

As mentioned above, the stating point color in this color order may be any one of six colors (Y, G, C, B, M and R) on the triangle on the x-y chromaticity diagram shown in FIG. 4. The order may be either anti-clockwise or clockwise rotation on the triangle on the x-y chromaticity diagram shown in FIG. 4.

By the method as discussed above, the color order for color sequential display used in the respective embodiments according to the invention is established.

Figure 26:
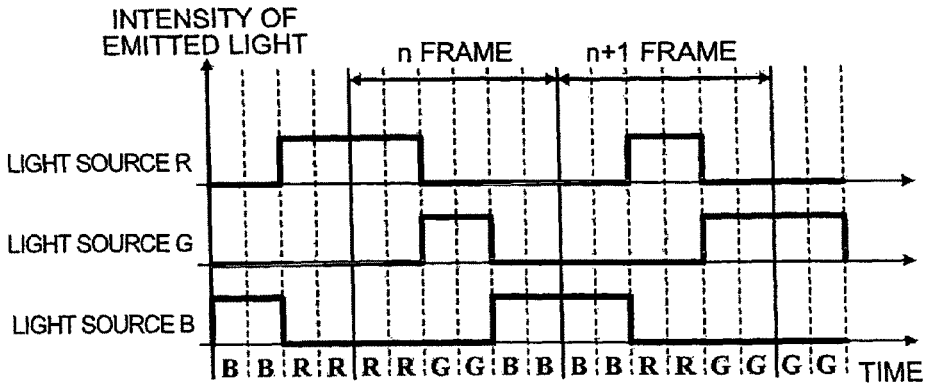
FIG. 26 shows a color order for color sequential display shown in JP-A-8-248381.

Next, the operation of the color signal distributing section 2 is discussed. Initially, the operation of the color signal distributing section 2 is explained with reference to FIGS. 5, 6 and 7. As mentioned above, the six color system is used in the respective embodiments according to the invention similarly to the method disclosed in JP-A-2003-280614. However, since the method according to the invention can perform color sequential display using three colors as in the case of JP-A-8-248381 shown in FIG. 26, color sequential display using the three color system of R, G and B as in the case of JP-A-8-248381 shown in FIG. 26 is initially explained.

Figure 5A:
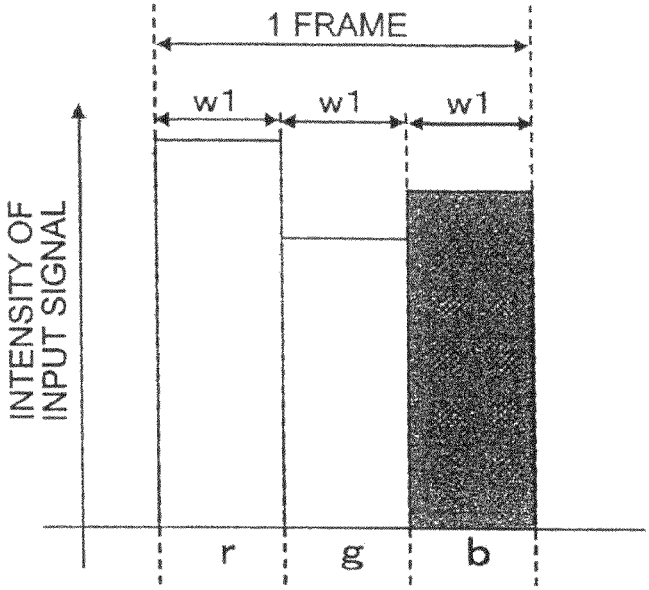
RELATED ART FIG. 5A
FIGS. 5A and 5B show an operation example of a color signal distributing section.

FIG. 5A shows color distribution processing for color sequential display using three colors of R, G and B similarly to the method shown in JP-A-8-248381. Since signals r, g and b in FIG. 5A are outputted from the image data input section 1 and inputted to the color signal distributing section 2, the signals r, g and b are hereinafter referred to as input signals r, g and b.

The width w1 of each rectangular region of the input signals r, g and b in FIG. 5A corresponds to the display time in each sub frame constituting one frame. In this embodiment, the same display time is given to the respective sub frames. Thus, the width w1 of the rectangular region is equal for each of the input signals r, g and b.

The height of each rectangular region indicates the intensity of the signals inputted to the color signal distributing section 2. While the intensity of the input signals is assumed as identical to the intensity of the actual light modulation output (output from the electro-optical modulation device 7) for simplifying explanation herein, this assumption does not impose any limitation.

Considering these conditions, the requirement for the time-divided display of the three colors R, G and B in accordance with the signals r, g and b inputted to the color signal distributing section 2 is that the area ratio of the respective rectangular regions is equal to the ratio of the input signals r:g:b. More specifically, since the value obtained by integrating the height of the rectangular region as the intensity of the light modulation output and the continuation time is recognized as a stimulation value to the human eyes, a color mixed with the three colors R, G and B at the ratio of r:g:b is recognized when the area ratio of the respective rectangular regions is r:g:b.

Figure 5B:
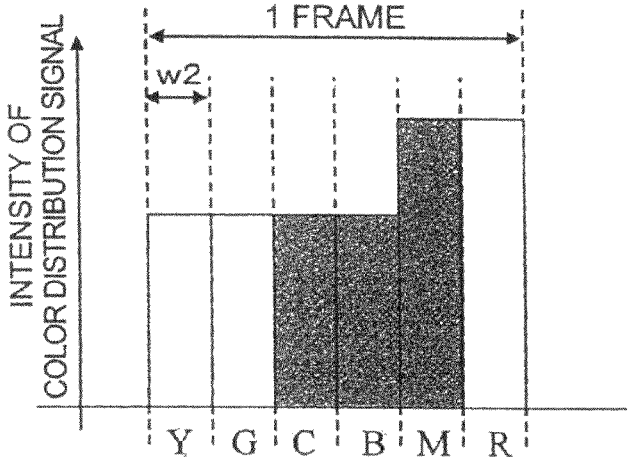

FIG. 5B shows a case when the six color system of Y, G, C, B, M and R is used instead of the three color system in FIG. 5A. The height of each rectangular region indicates the intensity of the color distribution signals for the colors Y, G, C, B, M and R, and the width w2 shows the display time of each sub frame corresponding colors of Y, G, C, B, M and R. Since the display time of each sub frame in FIG. 5B is half of the display time in the case of FIG. 5A, the width w2 of each rectangular region is also half of the width w1 of each rectangular region in FIG. 5A.

In the case of color display in FIG. 5B, the requirement for providing display equivalent to the case of FIG. 5A is that the areas of the color distribution signals at the time of light emission from the respective light sources R, G and B are the same as those in the case of FIG. 5A.

Since the color order of the color signals in the respective embodiments is Y, G, C, B, M and R, the R light source emits light in the sub frames Y, M and R, the G light source emits light in the sub frames Y, G and C, and the B light source emits light in the sub frames C, B and M according to this color order as also apparent from FIG. 2.

As shown in FIG. 2, it is assumed that the light-emission intensity does not vary within the light-emission sections of the respective light sources R, G and B. In this conditions, the displays in FIGS. 5A and 5B are equivalent if the following equations hold:

$$r=\tfrac{1}{2}\times(M+R+Y)$$

$$g=\tfrac{1}{2}\times(Y+G+C)$$

$$b=\tfrac{1}{2}\times(C+B+M) \qquad (2)$$

The value ½ on the right side in the respective equations in (2) corresponds to the length of each sub frame which is half of that in the case of color display using the three color system of R, G and B. As obvious, the following requirements need to be satisfied as well:

$$R\geqq 0,\ G\geqq 0,\ B\geqq 0,\ C\geqq 0,\ M\geqq 0,\ Y\geqq 0$$

This requirement simply comes from the reason that light having negative intensity cannot be emitted. When attention is given to the input signal b in FIG. 5A, for example, display corresponding to the input signal b is equal in both cases if the area of the rectangular region shaded with diagonal lines in FIG. 5A and the area of the rectangular regions C, B and M shaded with diagonal lines in FIG. 5B are the same.

Figure 6A:
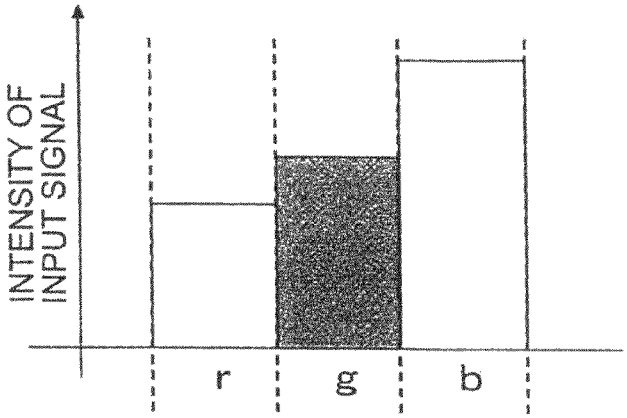
RELATED ART FIG. 6A
FIGS. 6A and 6B show another operation example of the color signal distributing section.
Figure 6B:
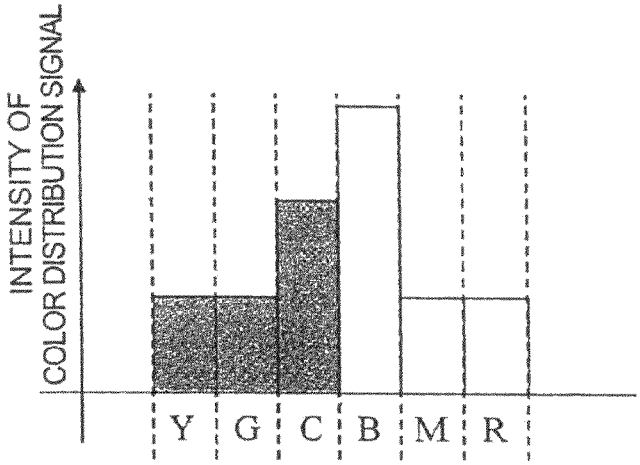

FIGS. 6A and 6B show a case different from the case in FIGS. 5A and 5B. Similarly to the case in FIG. 5A, FIG. 6A shows color distribution processing for color sequential display using the three color system of R, G and B similarly to the method shown in JP-A-8-248381. FIG. 6B shows color sequential display using the six color system of Y, G, C, B, M and R instead of three colors in FIG. 6A. In FIG. 6A, attention is given to the input signal g, for example. Display corresponding to the input signal g is equal in both cases if the area of the rectangular region shaded with diagonal lines in FIG. 6A and the area of the rectangular regions Y, G and C shaded with diagonal lines in FIG. 6B are the same.

However, the method of distributing a certain input signal to the reference colors and the complementary colors as shown in FIGS. 5 and 6 is not the only method.

Figure 7A:
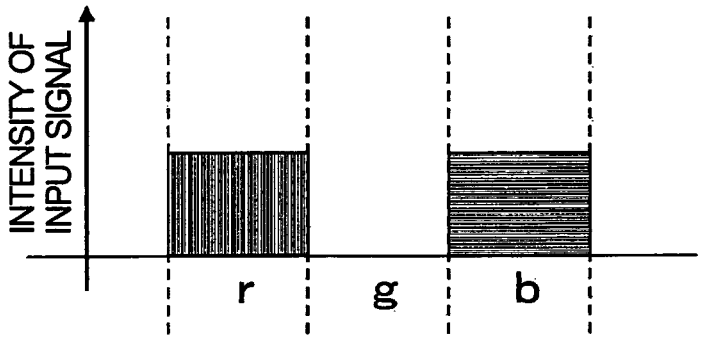
FIGS. 7A through 7D show distributions of color signals.
Figure 7B:
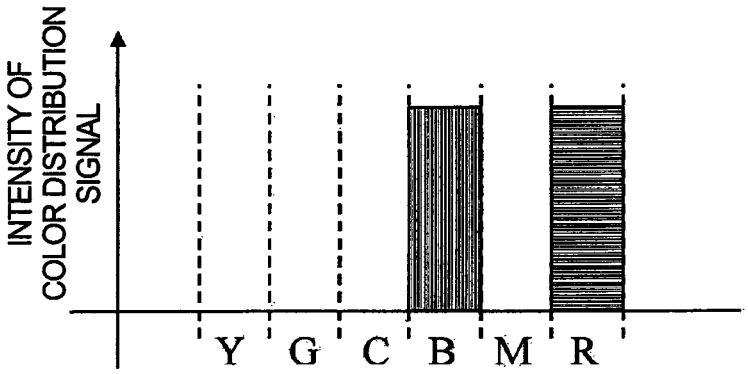

FIGS. 7A to 7D show distribution of the color signals. It is assumed herein that input signals shown in FIG. 7A are inputted to the color signal distributing section 2. For simplifying explanation, such a case where two input signals of the input signals r, g and b have the same value and the remaining one signal has the value of zero is considered. That is, it is assumed that complementary colors having certain intensity for a certain reference color having zero intensity are inputted. In FIG. 7A, a case where the input signal g is zero is considered. As an example of the color signal distributing method in this case, all the input signals can be allocated to the reference colors as shown in FIG. 7B.

Since the display time in FIG. 7B is half of that in the case of FIG. 5A, the distribution signals to be allocated to the reference colors are twice the input signals shown in FIG. 7A. By this method, the areas of the rectangular region shaded with vertical lines and the rectangular region shaded with horizontal lines in FIG. 7A and the areas of the rectangular region shaded with vertical lines and the rectangular region shaded with horizontal lines in FIG. 7B become equivalent. This gives the same stimulation value to the human eyes.

Figure 7C:
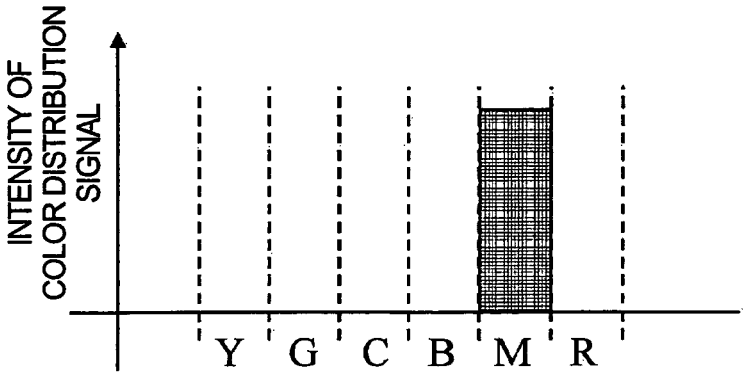
Figure 7D:
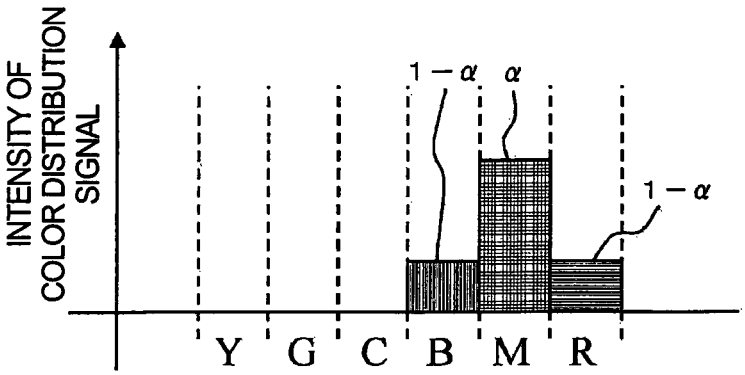

As still another example of the color distribution method, all the input signals can be allocated to the complementary color M as shown in FIG. 7C. In this case, since both the R light source and B light source emit light, the distribution signals have the same values as in the case of FIG. 7B, the total display time is half of the display time in FIG. 7B.

The both cases shown in FIGS. 7B and 7C are extreme cases. As a more generalized example, a part a ($1 \geqq \alpha \geqq 0$ herein) of the input signals can be allocated to the sub frames corresponding to the respective complementary colors, and the remaining part, i.e., $1-\alpha$ of the input signals can be allocated to the reference colors. Thus, FIG. 7B shows the case when $\alpha=0$, and FIG. 7C shows the case when $\alpha=1$. In the embodiments according to the invention, the value $\alpha$ is referred to as a color distribution ratio.

However, the color distribution ratio is not definitely determined by using the value $\alpha$. Thus, the additional requirement that the output values R, G, B, C, M and Y are all equal when the input signals r, g and b are all equal, that is, when colorless signals are inputted, is used. More specifically, in case of colorless signal input, the requirement that the signal level is not varied in all the sub frames constituting one frame is used.

When this requirement is employed, the gray scale display can be more accurately shown. Based on these requirements, the following expressions of equations for color distribution can be obtained.

$$C=\alpha\times\min(g,b)-(\alpha-1/3)\times\min(r,g,b)$$

$$M=\alpha\times\min(r,b)-(\alpha-1/3)\times\min(r,g,b)$$

$$Y=\alpha\times\min(r,g)-(\alpha-1/3)\times\min(r,g,b)$$

$$R=r-Y-M$$

$$G=g-Y-C$$

$$B=b-C-M \tag{3}$$

For simplifying the equations, the constant given due to reduction of display time to ½ is omitted. The equations (3) are hereinafter referred to as color distribution equations, and a ratio for display which is equivalent to the ratio of the input signals can be calculated using these equations. The function expressed as min is a function for returning the minimum value in the arguments.

The color distribution equations are now investigated. When the values r, g and b are all equal values V, for example, the terms including a are cancelled and thus all the values become $1/3\times V$. Therefore, when colorless signals are inputted, the requirement that the output values of all the sub frames are equal is satisfied. When values of r and g are V and b is zero, the value Y is $\alpha\times V$, the values of R and G are both $(1-\alpha)\times V$, and the remaining values are zero. Thus, these satisfy the requirements for the color distribution ratio.

The color signal distributing section 2 operates in this manner. The color distribution equations (3) can be calculated using a combination of function blocks shown in FIG. 8, for example.

Figure 8:
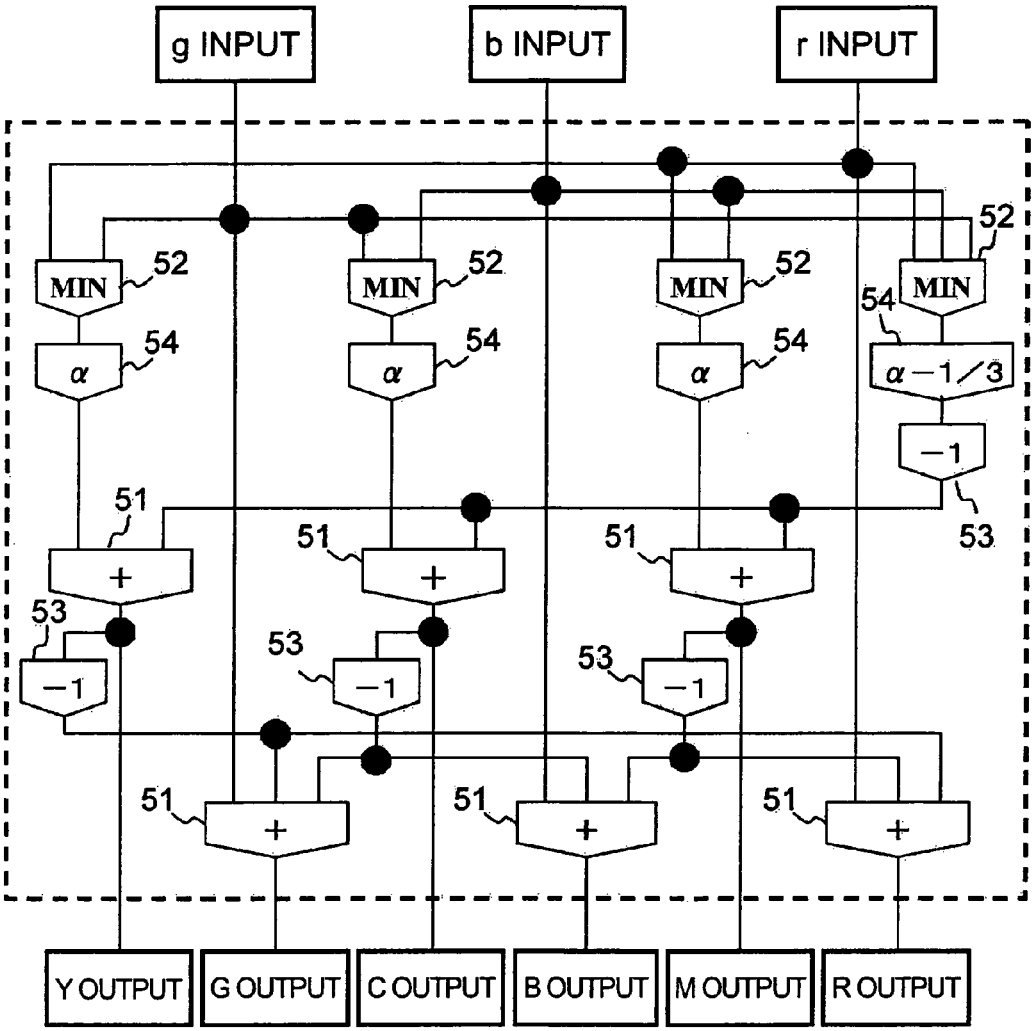
FIG. 8 shows a structure of a color distribution processing section for performing color signal distribution processing used in the respective embodiments as a combination of function blocks.

FIG. 8 shows a structure of the color signal distributing section 2 as a combination of function blocks for carrying out color signal distribution processing used in the respective embodiments according to the invention.

In FIG. 8, pentagons 51 to each of which "+" is given are function blocks for adding inputs and outputting the results of the addition. Pentagons 52 to each of which "MIN" is given are function blocks for selecting the minimum value in the inputs and outputting the selected value. Pentagons 53 to each of which the numeral "−1" is given are function blocks for multiplying the inputs by this numeral and outputting the results of the multiplication. Similarly, pentagons to each of which "a" or "$\alpha-1/3$" is given are multiplication function blocks for multiplying the inputs by $\alpha$ or $\alpha-1/3$ and outputting the results of the multiplication.

It is extremely easy to perform the functions of color signal distributing section 2 by hardware, or it is possible to perform these functions by software.

Next, the operation of the color distribution ratio setting section 8 is discussed. This section optimizes the value of the color distribution ratio $\alpha$ considering the effect of response delay of the electro-optical modulation device 7. The evaluation method for this optimization is initially explained with reference to FIG. 9.

Figure 9:
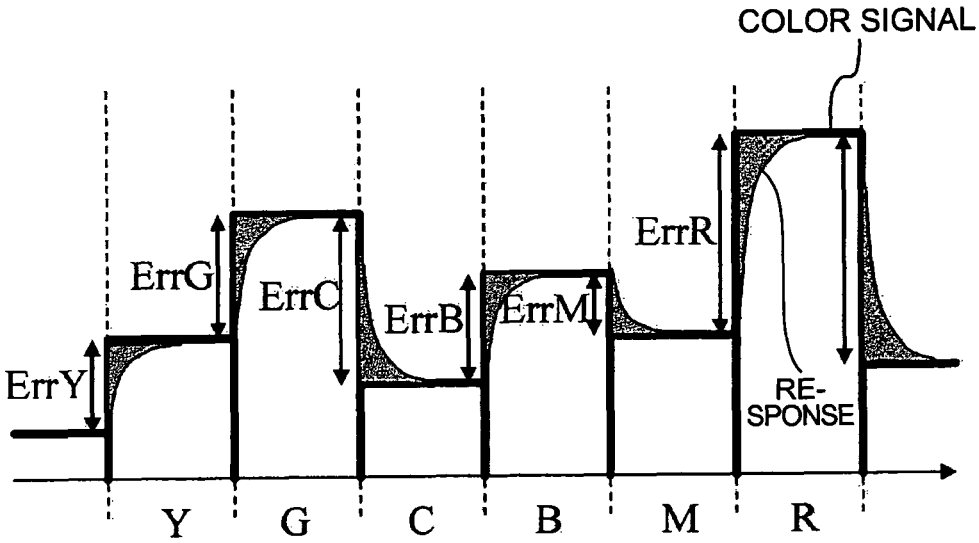
FIG. 9 shows errors caused due to response delays of an electro-optical modulation device from input signals.

FIG. 9 shows errors caused due to response delays of the electro-optical modulation device from the input signals. In FIG. 9, the order of Y, G, C, B, M and R is the color order used in the respective embodiments according to the invention, and input signals shown by black bold lines are given to the colors in this color order. As mentioned referring to FIGS. 5 and 6, the color signals are calculated such that the product of the intensity and the display time becomes a predetermined value, and the color signals are referred to as expected display signals.

Figure 25:
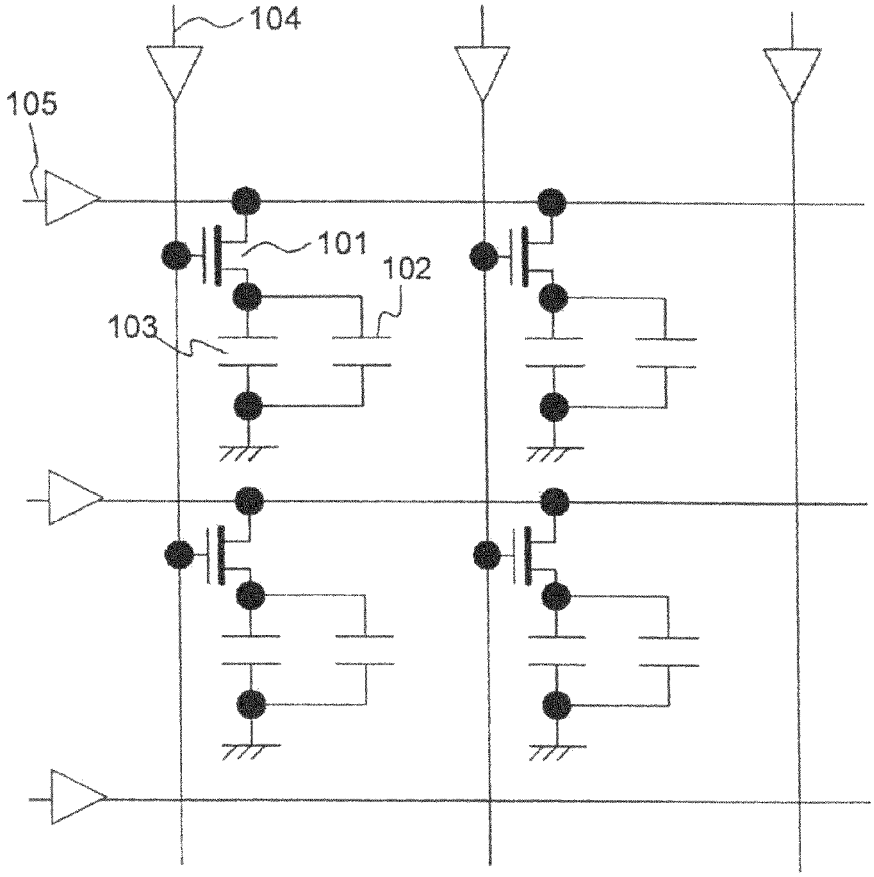
FIG. 25 schematically shows a TFT-type liquid crystal display element as an example of an electro-optical modulation device.

As explained referring to FIG. 25 and other figures, the actual response to the expected display signals is delayed by a certain time constant due to the response performance of the electro-optical modulation device 7. More specifically, the area shaded in FIG. 9 corresponds to the errors caused due to response delays of the electro-optical modulation device 7 from the expected display signals (hereinafter simply referred to as errors).

When the system is assumed as linear, these errors are proportional to signal differences of the respective color signals given to the corresponding sub frames among the respective sub frames. For example, when the signal difference produced when shifting from the sub frame corresponding to C to the sub frame corresponding to B is ErrB, the error caused at the sub frame corresponding to B is proportional to ErrB.

When the value of the ErrB is positive, the error is caused by insufficiency. When the value of ErrB is negative, the error is caused by excess. An error in a sub frame is dependent on the signal difference from the sub frame positioned immediately before this sub frame, and is thus dependent on the color order.

The errors produced by the signals distributed using the equations (3) can be quantitatively evaluated based on the values of the signal differences. The evaluation is easily calculated if the errors are analytically represented using a function of $\alpha$, but practically this is impossible.

Thus, in the embodiments according to the invention, α is evaluated by calculating errors for approximately 16,770,000 colors as all colors represented by the input signals r, g, b on the assumption that these input signals have 8-bit accuracy. A plurality of evaluations can be obtained depending on how the errors in the respective sub frames are considered.

For reference, the case of the color order Y, B, M, C, G and R used in the method of JP-A-2003-280614 is similarly evaluated herein. However, since this related art uses a color distribution method different from the method according to the invention, variables such as a used in the method according to the invention are not included. More specifically, the color signal distribution method according to JP-A-2003-280614 is a fixed method and description about this point is shown in the paragraph [0010] in the specification of JP-A-2003-280614. The following equations show this evaluation:

$$C=\min(g,b)-\tfrac{7}{8}\times\min(r,g,b)$$

$$M=\min(r,b)-\tfrac{7}{8}\times\min(r,g,b)$$

$$Y=\min(r,g)-\tfrac{7}{8}\times\min(r,g,b)$$

$$R=r-\tfrac{1}{2}\times(Y+M)$$

$$G=g-\tfrac{1}{2}\times(Y+C)$$

$$B=b-\tfrac{1}{2}\times(C+M) \quad (4)$$

The value ½ is included on the right side in the respective equations for calculating R, G and B in the equations (4) because it is recommended that the intensity of the light sources is reduced to ½ for the display of complementary colors according to JP-A-2003-280614 as shown in FIG. 27. An example of this evaluation is shown in FIG. 10.

Figure 10:
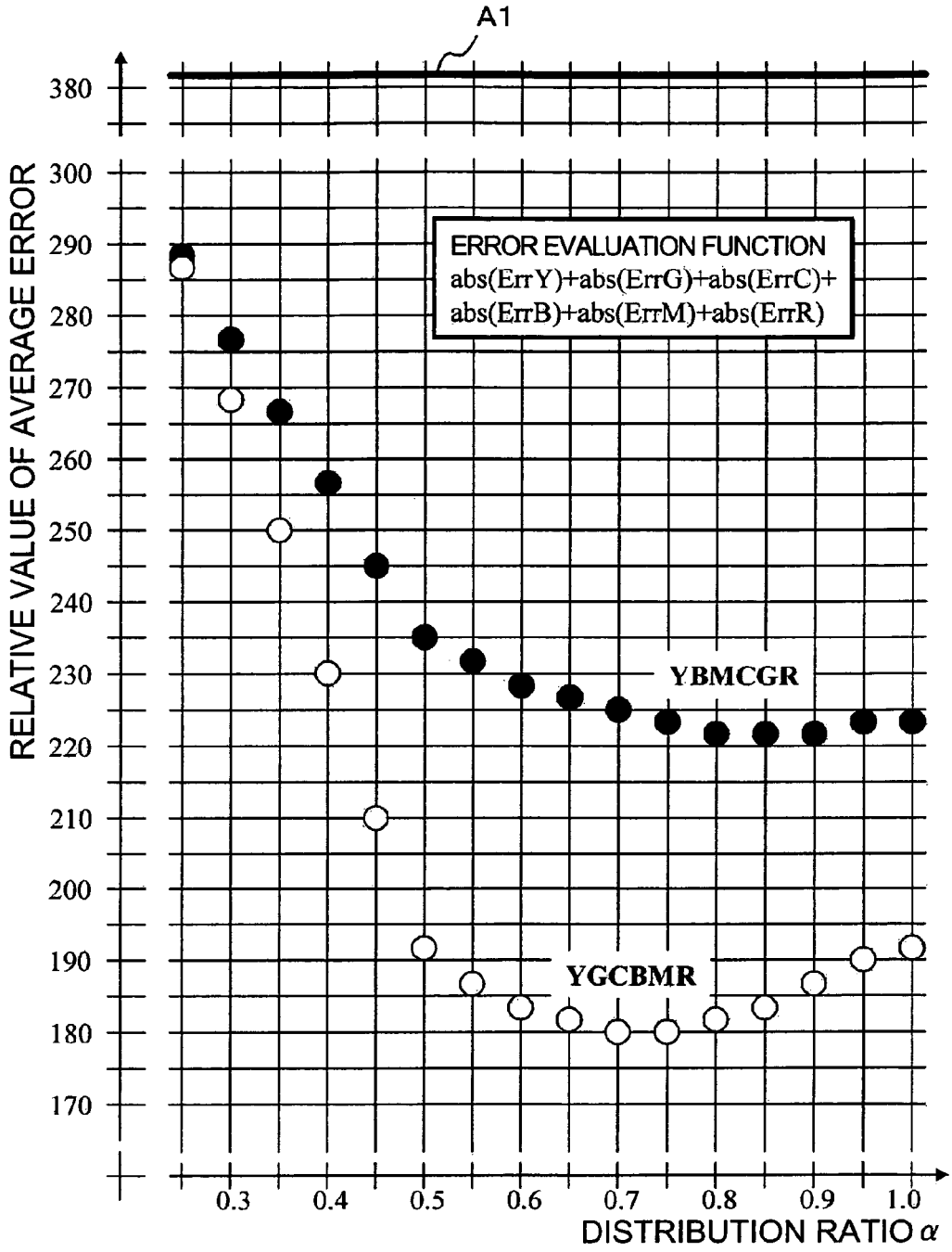
FIG. 10 shows the relationship between color distribution ratios α and relative values of average errors (1) in the first embodiment.

FIG. 10 shows the relationship between the color distribution ratios α and the relative values of the average errors (1) in the first embodiment. In FIG. 10, the errors in the respective sub frames (respective sub frames corresponding to Y, G, C, B, M and R) in a certain frame are considered by sub frame. The following equation is the evaluation equation for the errors:

$$abs(ErrY)+abs(ErrG)+abs(ErrC)+abs(ErrB)+abs(ErrM)+abs(ErrR) \quad (5)$$

Each abs in the equation (5) is a function for returning the absolute value of its argument.

In FIG. 10, the axis of abscissas indicates the color distribution ratios α, and the axis of ordinates indicates the errors (absolute values of average errors). The values indicated by a horizontally extending bold line A1 at the upper position in FIG. 10 are obtained by the method independent of α according to JP-A-2003-280614. The values indicated by black circles are obtained by the method according to the invention in the color order Y, B, M, C, G and R which is the same order as in the case of JP-A-2003-280614. The values indicated by white circles are obtained in the color order Y, G, C, B, M and R as a more preferable color order used according to the invention.

As apparent from FIG. 10, the minimum error (approx. 220) is obtained when the method according to the invention is used setting α at about 0.85 in the same color order of Y, B, M, C, G and R as that of JP-A-2003-280614. In this method, the error can be decreased to almost half the error (the value corresponding to the horizontal line A1) obtained by the method of JP-A-2003-280614. On the other hand, when the method according to the invention is used setting α at about 0.7 in the color order of Y, G, C, B, M and R of the invention, the error can be decreased to the minimum (approx. 180) which is equal to or lower than half of the error (the value corresponding to the horizontal line A1) obtained by the method of JP-A-2003-280614.

Figure 11:
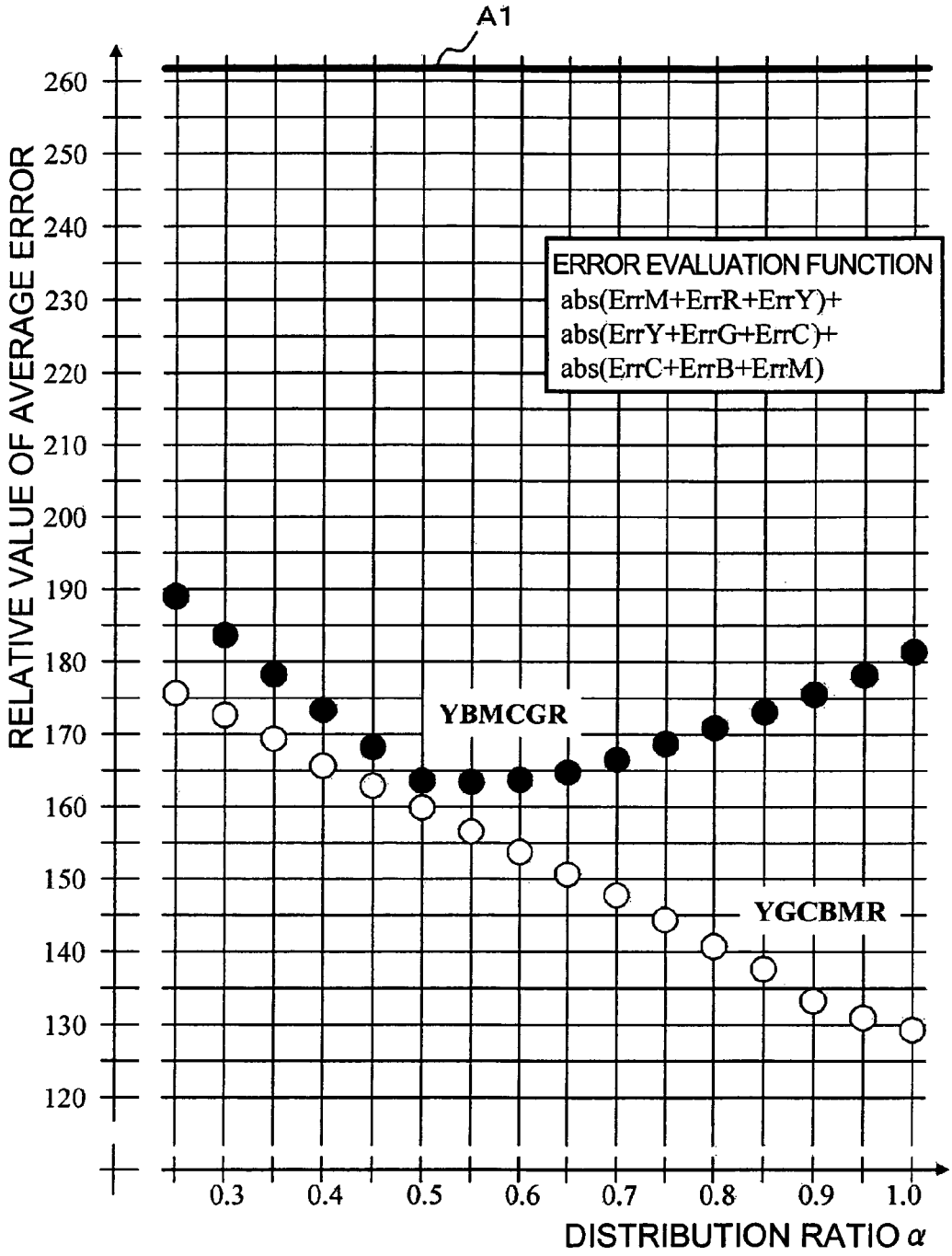
FIG. 11 shows the relationship between color distribution ratios α and relative values of average errors (2) in the first embodiment.

FIG. 11 shows the relationship between the color distribution ratios α and the relative values of the average errors (2) in the first embodiment. Since the stimulation values to the human eyes come from the reference colors R, G and B, the errors are evaluated for the three colors R, G and B at a time. More specifically, the R light source emits light in the sub frames M, R and Y, for example, and the errors in display can be reduced if the positive and negative values of the errors are cancelled out in the three sub frames according to this evaluation method. The evaluation equation in this method is as follows:

$$abs(ErrM+ErrR+ErrY)+abs(ErrY+ErrG+ErrC)+abs(ErrC+ErrB+ErrM) \quad (6)$$

The term "abs(ErrM+ErrR+ErrY)" indicates the error of the R element, the term "abs(ErrY+ErrG+ErrC)" indicates the error of the G element, and the term "abs(ErrC+ErrB+ErrM)" indicates the error of the B element in the equation (6).

In FIG. 11, similarly to the case in FIG. 10, the minimum error (approx. 165) is obtained when the method according to the invention is used setting α at about 0.55 in the same color order of Y, B, M, C, G and R as that of JP-A-2003-280614. In this method, the error can be decreased to almost half of the error (the value corresponding to the horizontal line A1) obtained by the method of JP-A-2003-280614 which is independent of the ratio α. On the other hand, when the method according to the invention is used setting α at about 1.0 in the color order of Y, G, C, B, M and R of the invention, the error can be decreased to the minimum (approx. 130) which is equal to or lower than half of the error (the value corresponding to the horizontal line A1) obtained by the method of JP-A-2003-280614 which is independent of the ratio α.

Figure 12:
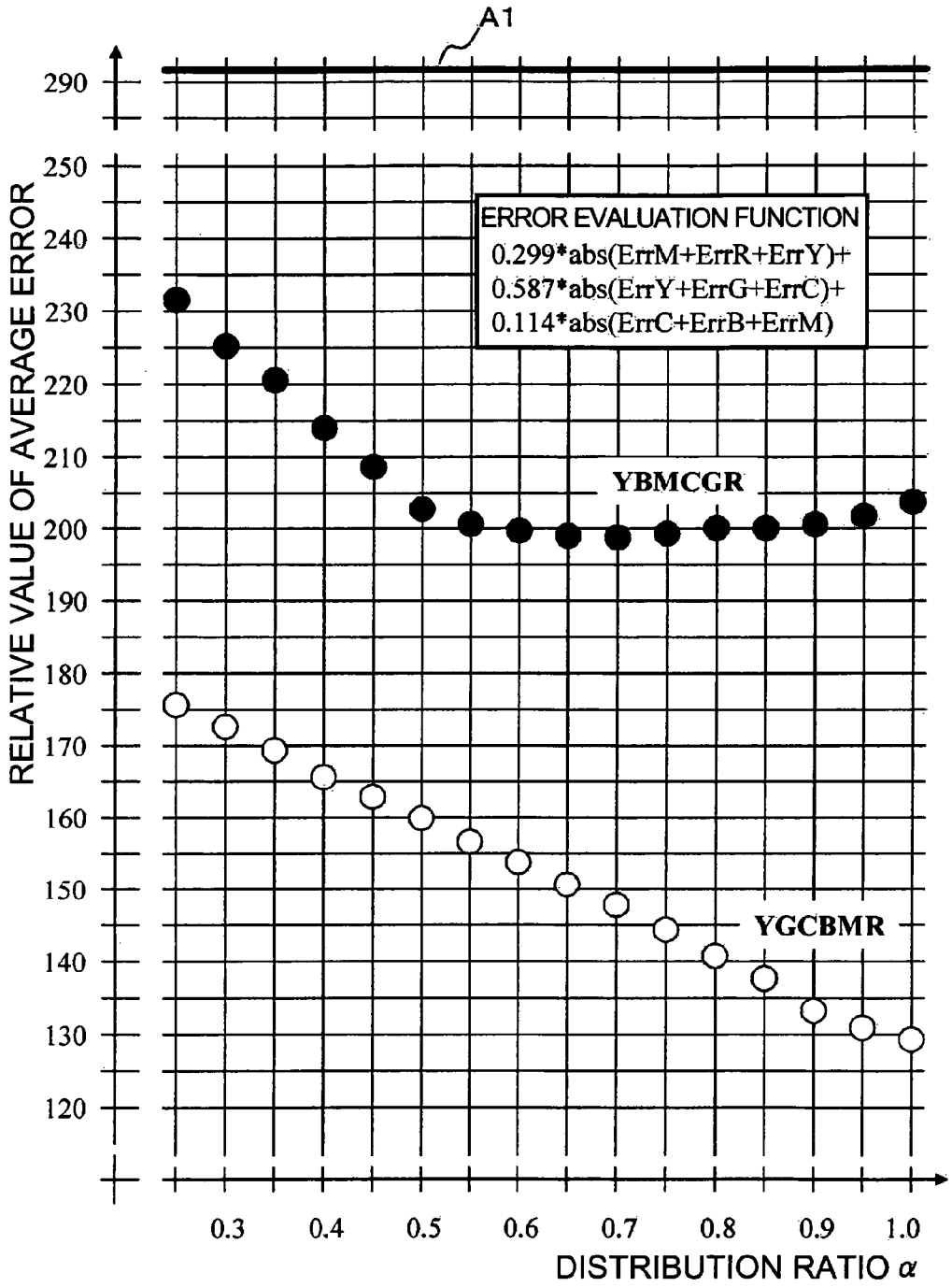
FIG. 12 shows the relationship between color distribution ratios α and relative values of average errors (3) in the first embodiment.

FIG. 12 shows the relationship between the color distribution ratios α and the relative values of the average errors (3) in the first embodiment. FIG. 12 shows the case where weights according to the human visual sensitivity are given to the errors of the R element, the G element, and the B element as well as the conditions shown in FIG. 11. The human vision has the highest sensitivity to the color G, and the lowest sensitivity to the color B. When these characteristics are included in the evaluation equation, the following is obtained:

$$0.299\times abs(ErrM+ErrR+ErrY)+0.587\times abs(ErrY+ErrG+ErrC)+0.114\times abs(ErrC+ErrB+ErrM) \quad (7)$$

The values "0.299", "0.587" and "0.114" in the equation (7) are weight coefficients, and generally used as the weight coefficients based on the human visual sensitivity.

As apparent from the equation (7), the largest weight is given to the error of the color G to which the visual sensitivity is the highest and the smallest weight is given to the error of the color B to which the visual sensitivity is the lowest in the colors R, G and B.

In FIG. 12, similarly to the cases in FIGS. 10 and 11, the error can be decreased to almost 70% of the error (the value corresponding to the horizontal line A1) obtained by the method of JP-A-2003-280614 when the method according to the invention is used setting α at about 0.65 in the same color order as that of JP-A-2003-280614. When the method according to the invention is used setting α at about 1.0 in the color order of the invention, the error can be decreased to a value equal to or lower than half of the error (the value corresponding to the horizontal line A1) obtained by the method of JP-A-2003-280614.

Figure 13:
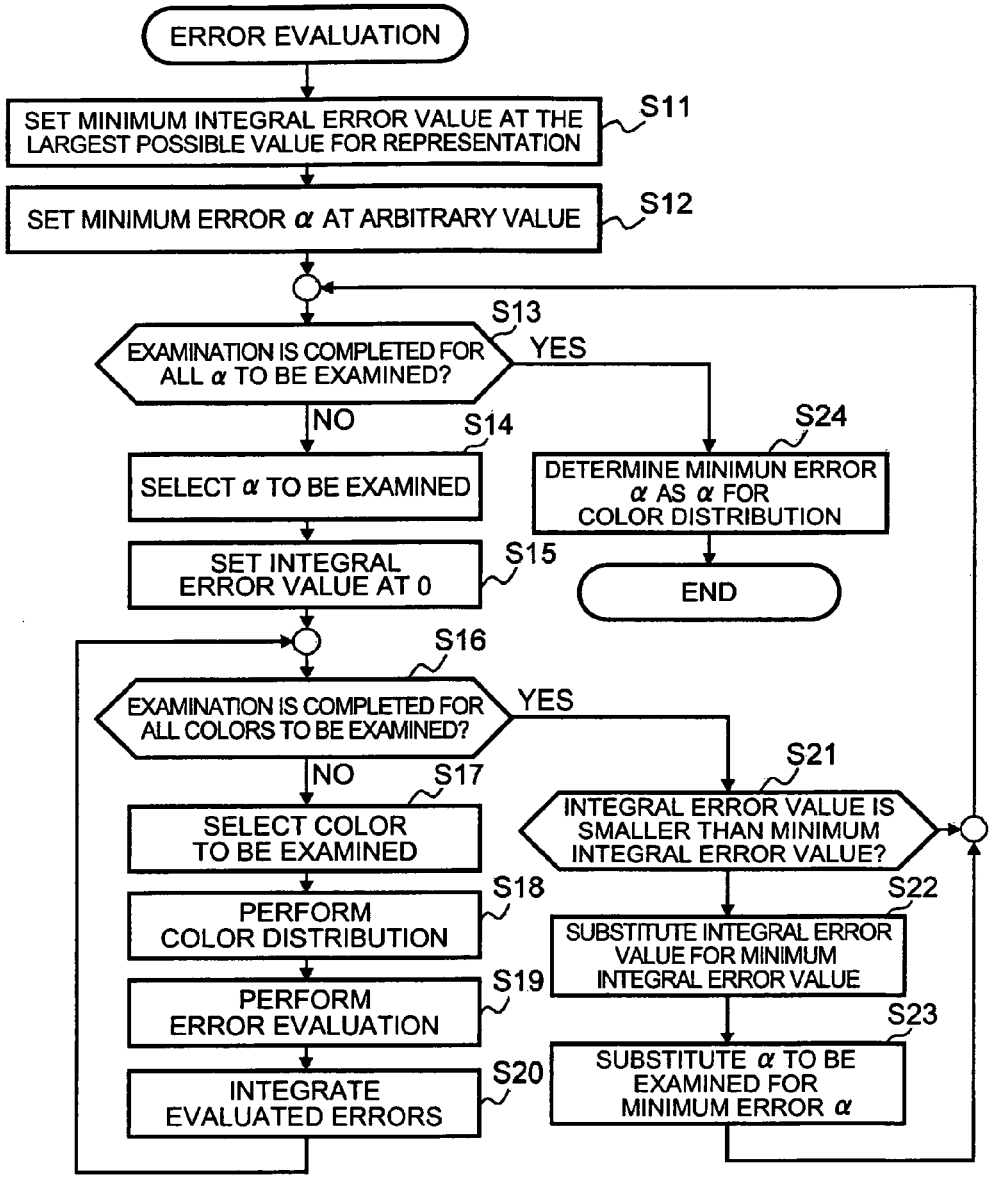
FIG. 13 is a flowchart showing a process for obtaining the optimum color distribution ratio α which reduces errors to the minimum.

FIG. 13 is a flowchart showing a process for calculating the optimum α which reduces the error to the minimum. As shown in FIG. 13, the minimum integral error value is initially set at the largest possible value for representation (step S11), and the minimum error value α is set at an arbitrary value (step S12). Then, it is determined whether all values α to be examined (hereinafter referred to as α to be examined) have been examined (step S13). If examination is not completed for all the values, an α to be examined is selected (step S14) and the integral error value is set at 0 (step S15).

Subsequently, it is determined whether examination is completed for all the colors to be examined (step S16). If examination is not completed for all the colors to be examined, a color to be examined is selected (step S17) and color distribution is performed (step S18). Then, error evaluation for this color distribution is performed (step S19), and the evaluated errors obtained by the error evaluation are integrated (step S20).

When the processes of steps S17 through S20 are completed for all the colors to be examined, it is determined whether the integral value of the evaluated errors obtained in step S20 (referred to as integral error value) is smaller than the minimum integral error value (step S21). When the integral error value is smaller than the minimum integral error value, the integral error value is substituted for the minimum integral error value (step S22) and the corresponding α to be examined is substituted for the minimum error α (step S23), thereafter returning to step S13. When it is determined that the integral error is larger than the minimum integral error value in step S21, the flow returns to step S13. If it is determined that the process is completed for all α to be examined in step S13, the minimum error α at the time of completion is determined as α for color distribution (color distribution ratio α) (step S24).

In the first embodiment, therefore, the errors caused due to response delays of the electro-optical modulation device 7 from the input signals can be minimized by establishing the color distribution ratio α using the color distribution ratio setting section 8 in the color order determined by the light source control section 4 and by appropriately distributing the signals given to the respective sub frames by the color signal distributing section 2 at the established color distribution ratio α.

When the color order is fixed in the image display method and the image display apparatus, the color distribution ratio can be also fixed. In addition, the color distribution ratio can be controlled by the user based on the subjective evaluation of the user.

The color distribution ratio may be controlled by direct designation of the ratio. Alternatively, the user may initially specify the color order and the color distribution ratio setting section may calculate the appropriate color distribution ratio based on the specified color order.

The color distribution ratio may be selected from record containing color distribution ratios for all possible color orders in the form of table, for example. When the six color system is used, for example, the number of combinations is the factorial of 6 divided by 2. The factorial of 6 is divided by 2 because an order and its reverse order are equivalent. The combinations thus calculated are 360 combinations. It is easy to calculate all possible combinations in advance and record them on a ROM or the like.

Alternatively, a color distribution ratio α for a given color order may be calculated every time the color order is established. In this case, the color distribution ratio α can be obtained according to the procedures shown in the flowchart of FIG. 13.

Second Embodiment

Figure 14:
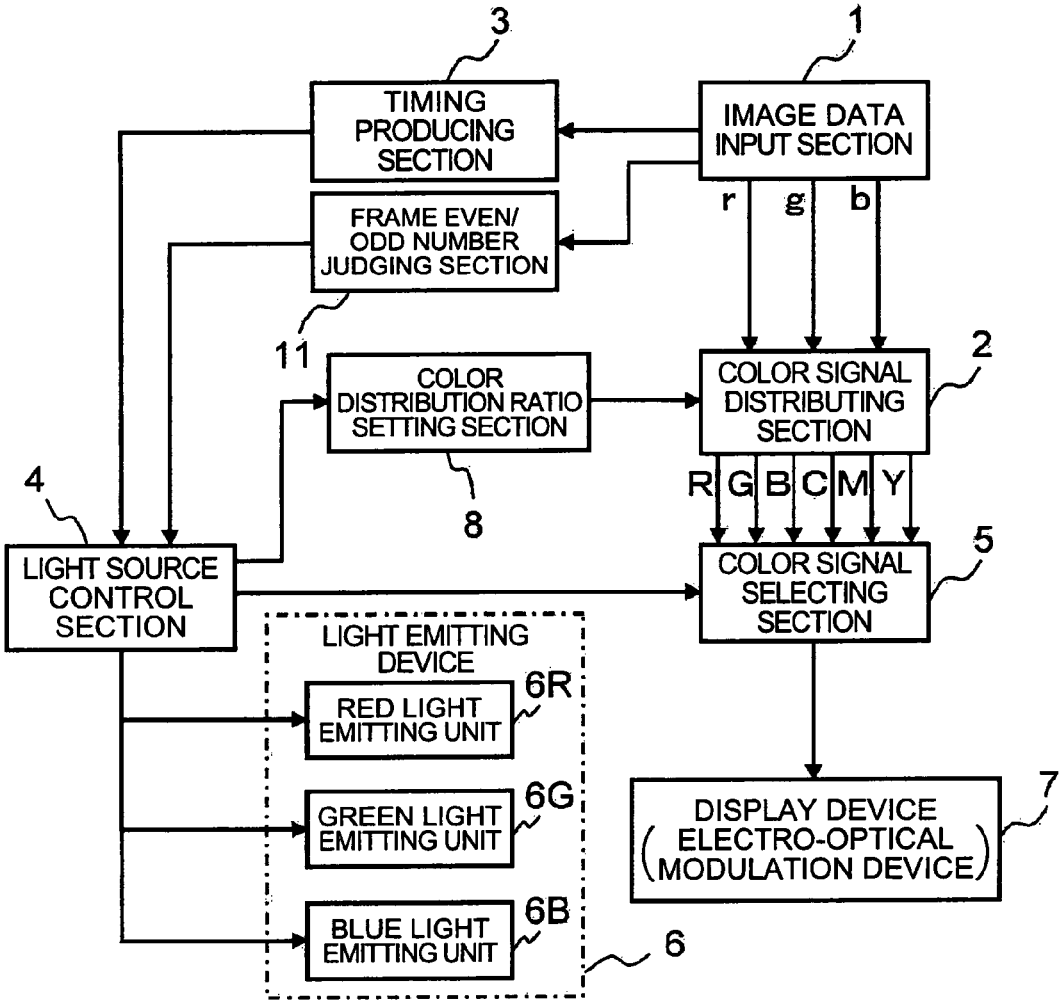
FIG. 14 illustrates a structure of an image display apparatus in a first embodiment.

FIG. 14 illustrates a structure of an image display apparatus in a second embodiment according to the invention. This image display apparatus has the same structure as that of the image display apparatus in the first embodiment (see FIG. 1) except that a frame even/odd number judging section 11 is added. Similar reference numbers are given to similar components. The second embodiment is hereinafter described.

The method according to the first embodiment reduces the errors to the minimum within one frame. However, if two frames are considered as one unit, greater reduction of the errors can be expected.

Figure 15:
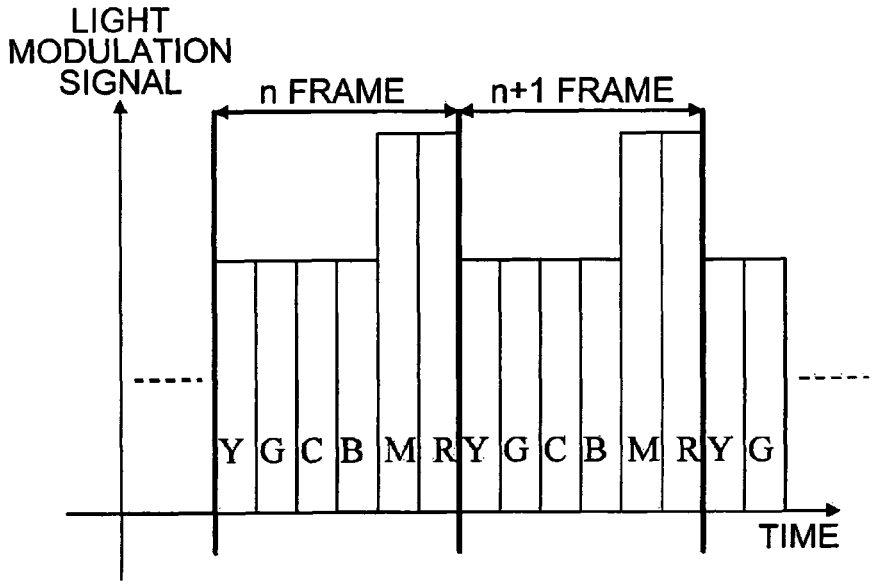
FIG. 15 shows two frames (n frame and n+1 frame) of the respective color signals shown in FIG. 5B as an example.

FIG. 15 shows two frames (n frame and n+1 frame) as an example each of which includes the respective signals shown in FIG. 5B.

Generally, a dynamic image has a characteristic that one frame is highly correlated with the frame positioned immediately before this frame. Thus, the condition shown in FIG. 15 frequently occurs. More specifically, there is a high probability that the color displayed by one frame is the same as the color displayed by the frame immediately before this frame at the same display position.

The errors within one frame (n frame, for example), that is, the signal differences among six sub frames constituting the n frame are optimized by the method according to the first embodiment. However, as apparent from FIG. 15, the signal difference at the boundary of the adjoining two frames (boundary between n frame and n+1 frame in FIG. 15) is not taken into account in the first embodiment. Thus, in the case of FIG. 15, a large signal difference is produced at the boundary between the n frame and the n+1 frame. This difference is taken into consideration in the second embodiment.

According to the second embodiment, the successive two frames are considered as one unit and the color order of one of the frames is reversed. More specifically, it is determined whether the frame number of the image data is an even number or an odd number by the frame even/odd number judging section 11. When it is determined that the first frame is an odd number frame and the second frame is an even number frame in the two frames, for example, the color order of the frame determined as the even number frame is reversed as a reverse order of the odd number frame color order.

Figure 16:
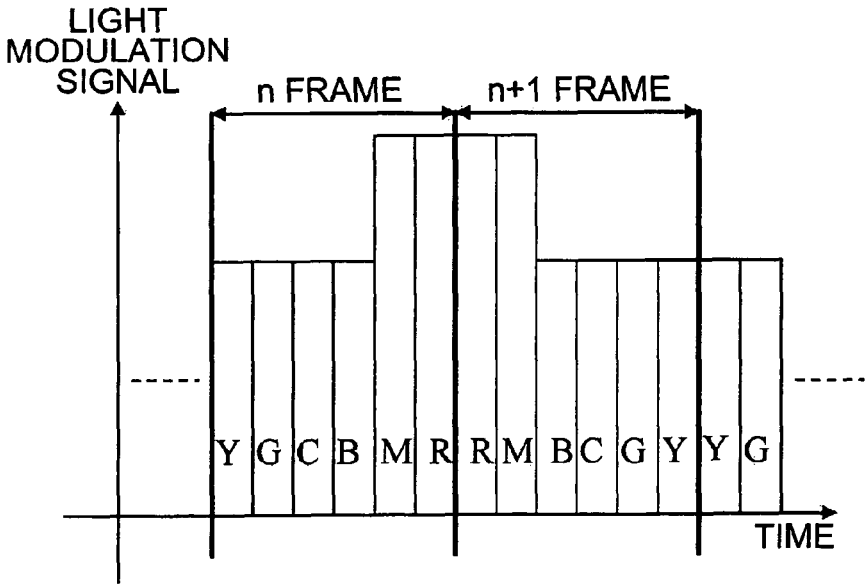
FIG. 16 shows an example in which a color order of an even number frame (n+1 frame) shown in FIG. 15 is reversed.

FIG. 16 shows an example in which the color order of the even number frame (n+1 frame) shown in FIG. 15 is reversed. As shown in FIG. 16, the color order of the n frame (odd number frame) is Y, G, C, B, M and R, but the color order of the n+1 frame (even number frame) is R, M, B, C, G and Y, which is the reversed color order of Y, G, C, B, M and R.

In this case, the large signal difference on the boundary between the n frame and the n+1 frame shown in FIG. 15 is eliminated. Thus, in the condition that the same color is successively displayed within the adjoining two frames, the signal difference on the boundary between the successive two frames is reduced to zero as shown in FIG. 16.

Figure 17:
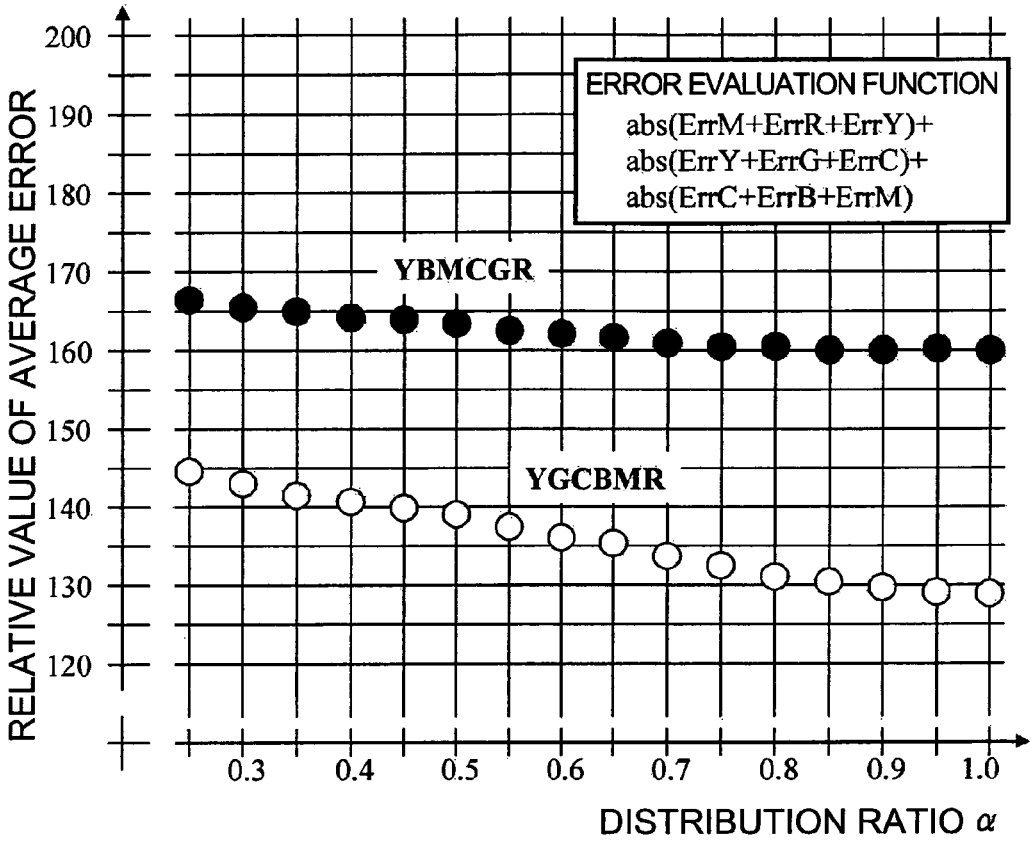
FIG. 17 shows the relationship between color distribution ratios α and relative values of average errors when a same evaluation as in FIG. 11 shown in the first embodiment is executed in the second embodiment.

FIG. 17 shows the relationship between the color distribution ratios α and the relative values of average errors obtained when the evaluation in the first embodiment shown in FIG. 11 is executed in the second embodiment. As apparent from FIG. 17, variations in the errors relative to the values α can be made smaller in the second embodiment than in the first embodiment. This is qualitatively understandable as a result from the situation that the cause for producing large errors particularly on the boundary of frames as in FIG. 15 is eliminated. That is, the display errors can be reduced in a more stable manner in the second embodiment than in the first embodiment.

Third Embodiment

Figure 18:
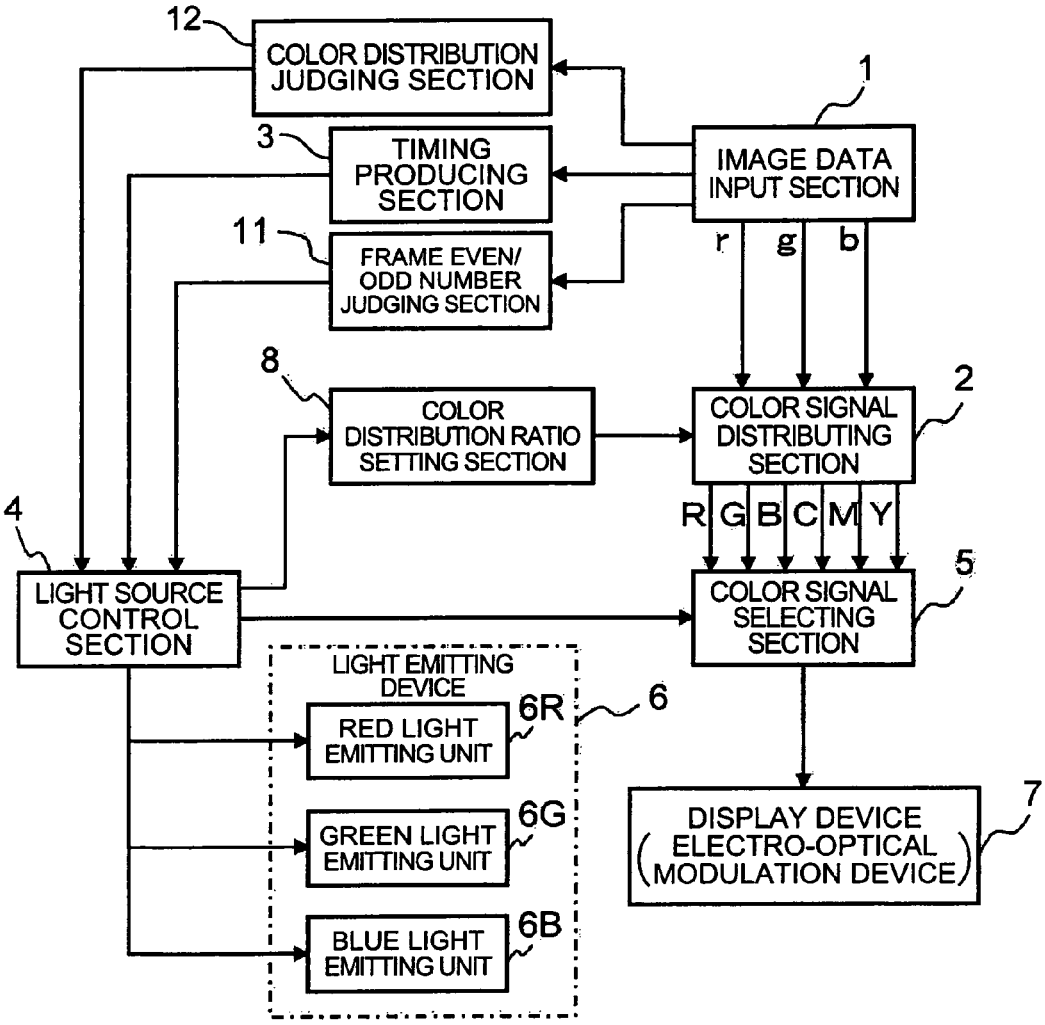
FIG. 18 illustrates a structure of an image display apparatus in a third embodiment.

FIG. 18 illustrates a structure of an image display apparatus in a third embodiment according to the invention. This image display apparatus has the same structure as that of the image display apparatus in the second embodiment (see FIG. 14) except that a color distribution judging section 12 is added. Similar reference numbers are given to similar components. The third embodiment is hereinafter described.

In the second embodiment, the signal difference on the boundary between the two successive frames is reduced to substantially zero so as to improve the display accuracy by judging whether the numbers of the frames are even or odd numbers and reversing the color order of one of the frames. Remarkable advantages can be offered by this simple method, but obviously the advantages are insufficient in some cases.

Figure 19:
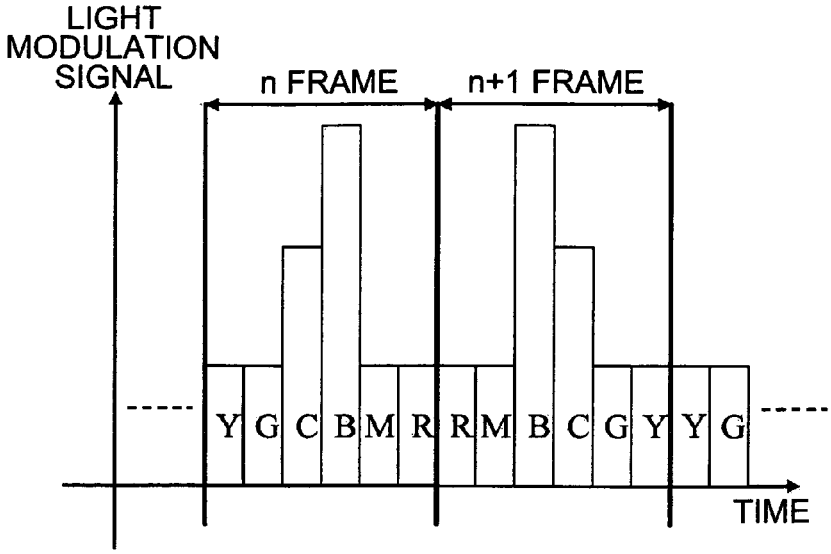
FIG. 19 shows an example in which the method according to the second embodiment is used in the case of FIG. 6B.

FIG. 19 shows an example in which the method according to the second embodiment is used in the case of FIG. 6B. In this case, the high intensity part of the input signal is positioned in the middle part sub frames in the plural sub frames constituting each frame (n frame, n+1 frame). Thus, even when the color order of the n+1 frame is reversed establishing the color order of Y, G, C, B, M and R for the n frame and the reversed color order of R, M, B, C, G and Y for the n+1 frame according to the method of the second embodiment, sufficient advantages cannot be offered. The method in the third embodiment overcomes this drawback.

Figure 20:
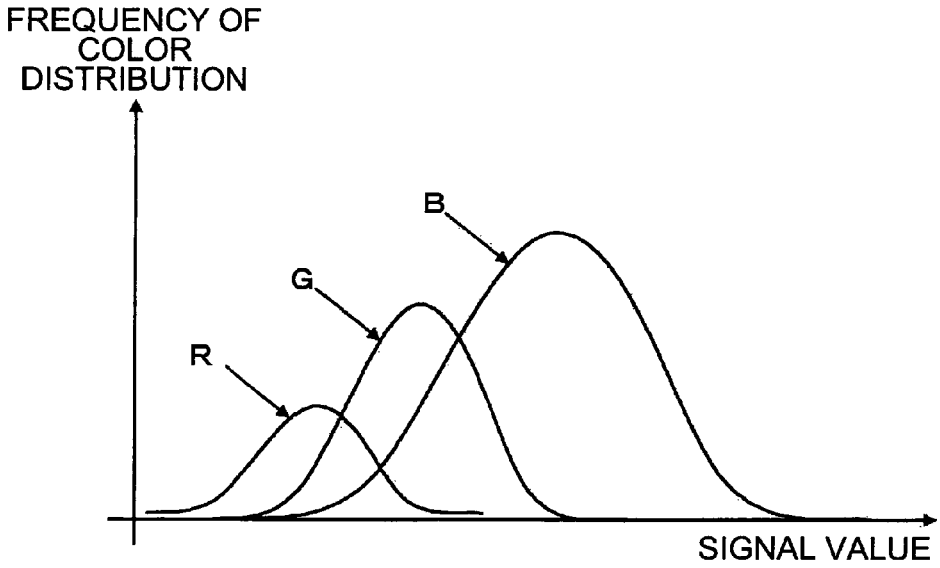
FIG. 20 shows an example of color distributions in a frame judged by a color distribution judging section.

The operation of the method according to the third embodiment is now explained. Initially, color distributions of image data within frames to be displayed are calculated by the color distribution judging section 12 prior to display. FIG. 20 shows an example of the color distributions.

FIG. 20 illustrates an example of color distribution of a certain frame judged by the color distribution judging section 12. In FIG. 20, the axis of abscissas indicates the signal intensity, and the axis of ordinates indicates numbers in units of display for corresponding signal intensity, i.e., frequencies of color distribution. For example, the color distribution shown in FIG. 20 shows that the color B (blue) is widely distributed in such cases as the seashore scenery and the scenery containing blue sky. This color distribution corresponds to the case of FIG. 6B.

In this case, even when the color order of the n+1 frame in the two frames of the n frame and the n+1 frame is reversed using the method of the second embodiment, a large signal difference is still produced on the boundary between the successive two frames as illustrated in FIG. 19. Thus, sufficient advantages cannot be offered by the method of the second embodiment for the image data having the color distribution shown in FIG. 6B.

However, if the color distribution of the frame to be displayed is recognized as the one shown in FIGS. 6A and 6B, advantages similar to those in the optimum case of the second embodiment can be provided by changing the color order for color sequential display.

For example, when it is determined that the color distribution is as shown in FIG. 20 by the color distribution judging section 12, the color orders of the n frame and the n+1 frame within each frame are altered such that the signal difference on the boundary between the n frame and the n+1 frame can be reduced to substantially zero in the method according to this embodiment.

Figure 21:
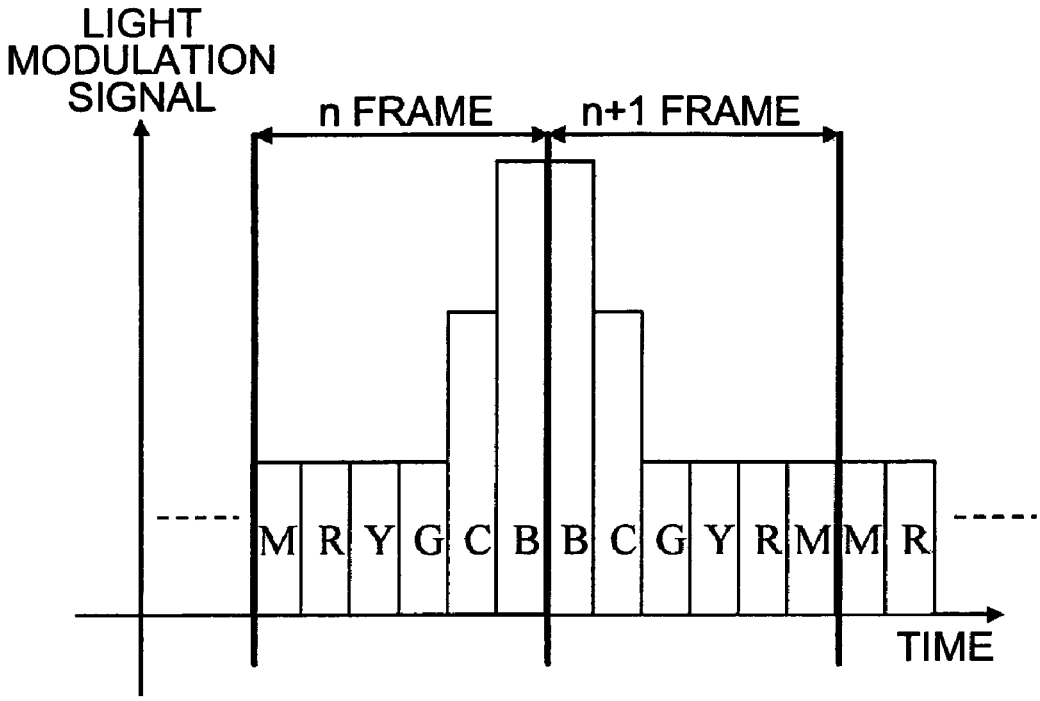
FIG. 21 shows an example in which a color order of the n+1 frame is reversed and a color order within each frame is changed.

FIG. 21 shows an example in which the color order within each frame is changed. In this case, it is preferable that the color order is rotated for the change of the color order.

In the case of FIG. 21, the color order of Y, G, C, B, M and R is rotated for two sub frames in the right direction in the figure such that widely distributed blue (B) can be positioned on the frame boundary (boundary between n frame and n+1 frame), establishing the color order of M, R, Y, G, C and B in the n frame. On the other hand, the color order of the n+1 frame is reversed as B, C, G, Y, R and M.

By this method, the signal difference on the boundary between the successive frames can be eliminated as illustrated in FIG. 21.

Figure 22:
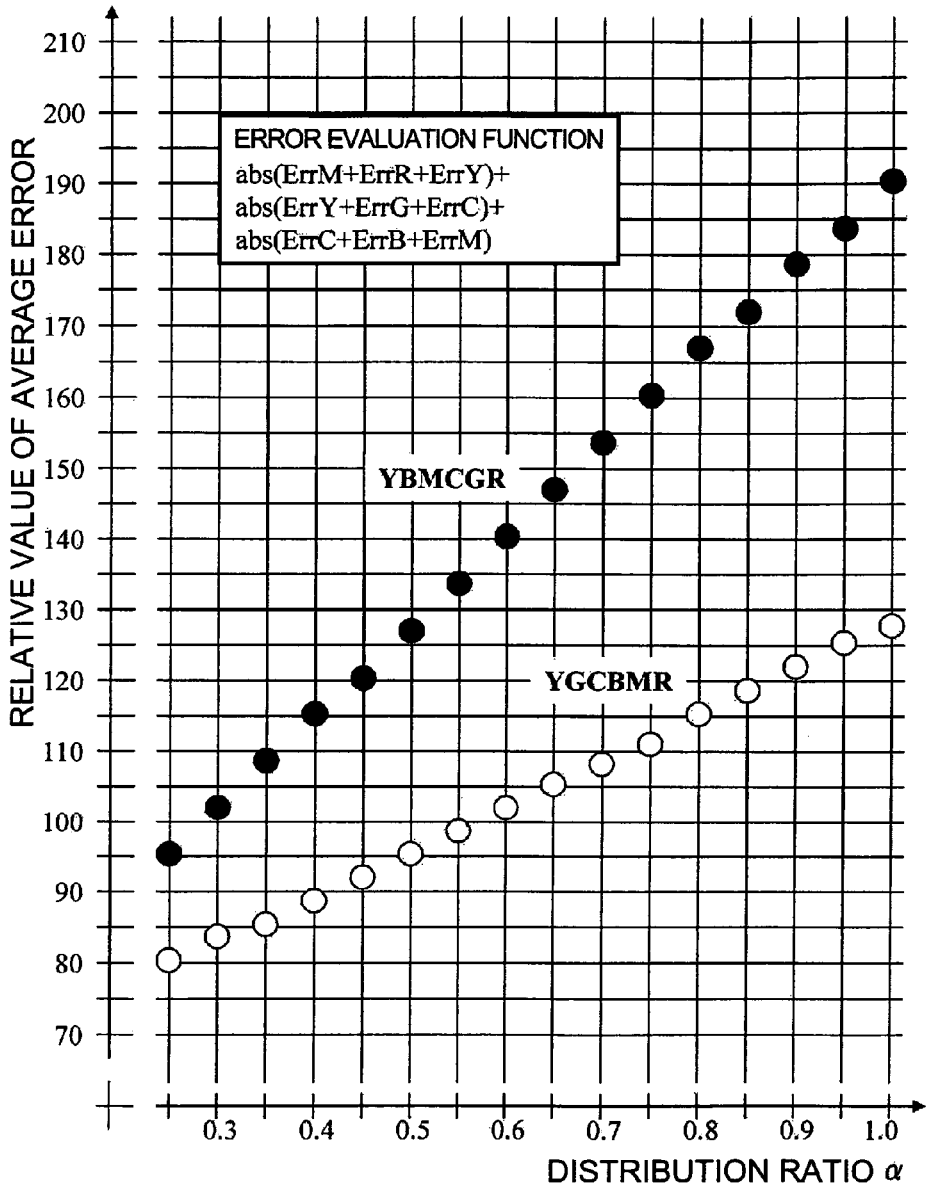
FIG. 22 shows the relationship between color distribution ratios α and relative values of average errors when a same evaluation as in FIG. 11 shown in the first embodiment is executed in the third embodiment.

Since the method according to the third embodiment judges color distribution within a frame of image data to be displayed using the color distribution judging section 12 and alters the color order according to the results of judgment, the method is dependent on the image data to be displayed. It is therefore difficult to quantitatively show general advantages offered by the method according to the third embodiment, but an example is shown in FIG. 22 in which the evaluation in FIG. 11 is executed assuming that the same color occupies the majority part. As apparent from FIG. 22, the minimum error can be obtained when $\alpha$ is about 0.25.

According to the method of the third embodiment, the errors can be reduced even in the case where the widely distributed color signals of the image data are positioned in the middle part sub frames of the plural sub frames constituting one frame, to which image data the method of the second embodiment cannot offer sufficient advantages.

Fourth Embodiment

Figure 23:
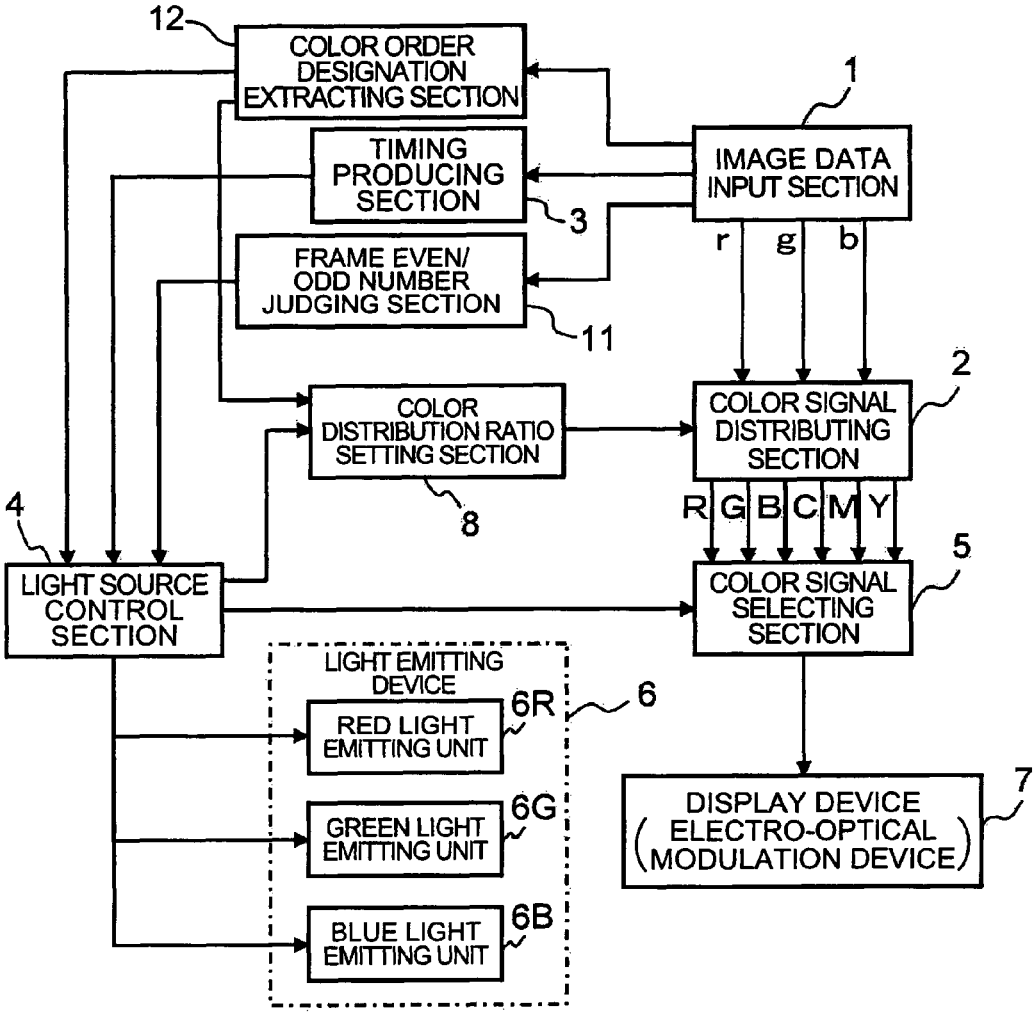
FIG. 23 illustrates a structure of an image display apparatus in a fourth embodiment.

FIG. 23 illustrates a structure of an image display apparatus in a fourth embodiment according to the invention. This image display apparatus has the same structure as that of the image display apparatus in the third embodiment (see FIG. 18) except that a color order extracting section 13 is added in lieu of the color distribution judging section 12. Similar reference numbers are given to similar components. The fourth embodiment is hereinafter described.

According to the method of the fourth embodiment, the color order setting process as in the third embodiment, that is, the color order setting process and the like based on the results of judgment about the color distribution provided by the color distribution judging section 12 are carried out in advance, so as to enter the established color order information, the color distribution ratio information for the respective colors in the established color order and other information into the data of images to be displayed in advance.

Figure 24A:
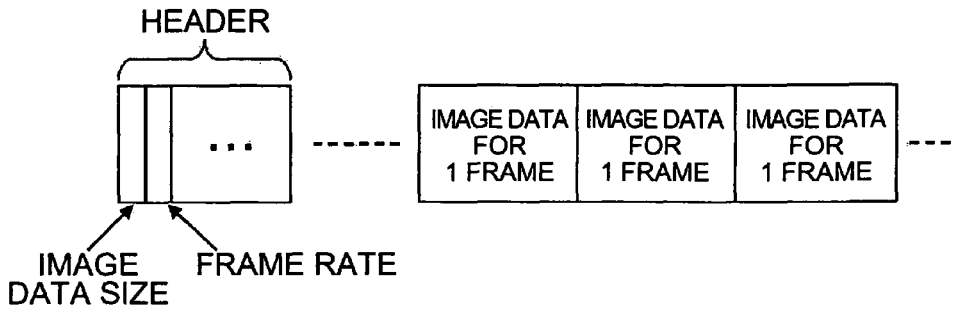
FIGS. 24A to 24C show formats of image data used in the fourth embodiment.
Figure 24B:
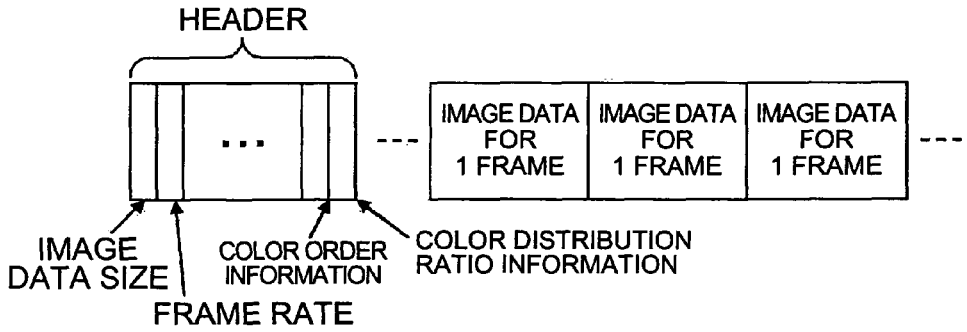
Figure 24C:
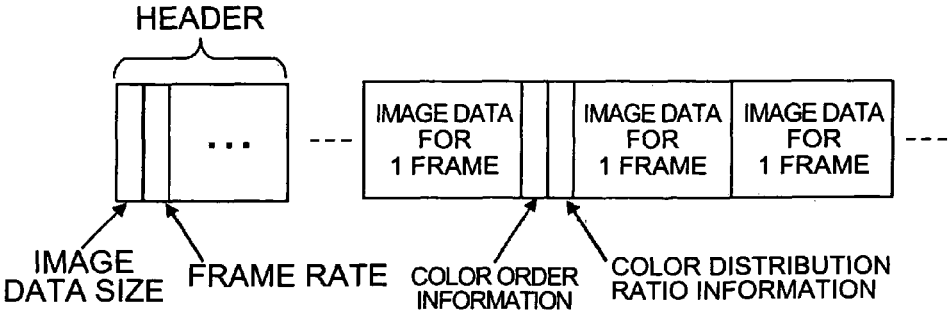

FIGS. 24A to 24C show formats of image data used in the fourth embodiment. A typical format of image data has a structure shown in FIG. 24A. As illustrated in FIG. 24A, information for display such as image data size and frame rate, and other information as header information are written to a block indicated as "header".

As illustrated in FIG. 24B, color order information, color distribution ratio information can be included as a part of the header information, for example. By using this information for display, equivalent advantages can be offered through an extremely easier process than in the third embodiment.

As illustrated in FIG. 24C, the color order information and color distribution ratio information can be included for each frame. By this method, the person who creates the image data can specify how the respective frames are displayed.

For example, when a large number of pixels of a particular color are contained in display but a smaller number of another color are desired to be displayed more accurately according to the intention of the creator of the data, this intension can be entered as the color order information and color distribution ratio information. Moreover, when it is desired to reduce color splits in such scenes containing large motions while allowing deterioration in display accuracy to some extent or when it is desired to increase display accuracy while not considering color splits since data contains almost still images, the data can be specified as such. These designations are extracted by the color order designation extracting section 13 shown in FIG. 23, and transmitted to the light source control section 4 and other sections. By this method, errors can be reduced considering intensions of the data creator.

The invention is not limited to the embodiments described and depicted herein, and various modifications and alterations may be given to the invention without departing from the scope thereof. For example, while the transmissive-type liquid crystal display device is used as the electro-optical modulation device 7 in the respective embodiments, a reflection-type display device such as a DMD (registered trademark) and a LCOS may be employed. Additionally, while R, G and B are used as reference colors in the respective embodiments, the colors are not limited to those. Also, the light emitting units are not limited to LEDs.

According to the invention, a processing program containing image display processing procedures for realizing the invention may be created, and this processing program may be recorded on various recording media. Thus, the scope of the invention includes recording media on which the image display processing program is recorded. The image display processing program may be obtained from a network.

The entire disclosure of Japanese Patent Application No. 2005-052610, filed Feb. 28, 2005 is expressly incorporated by reference herein.

What is claimed is:

1. An image display method comprising:

providing a light source and an electro-optical modulation device which modulates light emitted from the light source in accordance with a plurality of color signals of image data in a predetermined color order;

obtaining information relating to a delay within a single frame displayed by the electro-optical modulation device, the information relating to the delay being determined based on a variation between different color signals of the plurality of color signals within the single frame;

establishing color distribution ratios for the plurality of color signals within the single frame based on the information relating to the delay within the single frame displayed by the electro-optical modulation device;

performing error evaluation by determining a volume of errors caused due to the delay of the electro-optical modulation device from the plurality of color signals based on quantities of intensity variation in the plurality of color signals, the quantities of intensity variation in the plurality of color signals being obtained by integrating absolute values of the quantities of intensity variation in the respective color signals; and generating the plurality of color signals based on the color distribution ratios.

2. An image display method according to claim 1, wherein:

the plurality of color signals include N reference colors (N: 3 or larger integer) and N complementary colors of the N reference colors; and the color order including the N reference colors and N complementary colors is such a color order that the N reference colors and N complementary colors are alternately allocated in a predetermined color order or a reversed color order in 2N sub frames of one frame which includes the N reference colors and the N complementary colors.

3. An image display method according to claim 1, wherein the quantities of intensity variation in the plurality of color signals are calculated by: dividing a plurality of colors of lights, which are emitted from respective light-emitting units for emitting lights of N reference colors, into a plurality of groups allowing overlaps; calculating an integral value of the quantities of intensity variation in the plurality of color signals for each color contained in each group; and adding the absolute values of the integral values obtained for the respective groups to calculate the quantities of intensity variation in the plurality of color signals.

4. An image display method according to claim 3, wherein weights according to the volumes of visual sensitivity of the human eyes to colors are given to the integral values of the quantities of intensity variation obtained for the respective groups.

5. An image display method according to claim 2, wherein the color order is any one of the color orders of: R, Y, G, C, B and M; Y, G, C, B, M and R; G, C, B, M, R and Y; C, B, M, R, Y and G; B, M, R, Y, G and C; M, R, Y, G, C and B; R, M, B, C, G and Y; M, B, C, G, Y and R; B, C, G, Y, R and M; C, G, Y, R, M and B; G, Y, R, M, B and C; and Y, R, M, B, C and G when the N reference colors are R (red), G (green) and B (blue) and the N complementary colors are C (cyan), M (magenta) and Y (yellow).

6. An image display method according to claim 1, wherein the color order of one of successive two frames as one unit in the image data is reversed.

7. An image display method according to claim 6, wherein, when it is determined that a widely distributed color signal is positioned in the middle or around the middle sub frame of the plural sub frames contained in a frame by the judgment of color distribution of the frame in the image data, the color order is changed such that the sub frame corresponding to the widely distributed color signal can be positioned on the boundary between the successive two frames.

8. An image display apparatus for providing display in a predetermined color order using a plurality of color signals of image data for an electro-optical modulation device which modulates light emitted from a light source in accordance with signals, comprising:

a color distribution ratio setting section for:

establishing color distribution ratios for the plurality of color signals;

obtaining information relating to a delay within a single frame displayed by the electro-optical modulation device, the information relating to the delay being determined based on a variation between different color signals of the plurality of color signals within the single frame;

performing error evaluation by determining a volume of errors caused due to the delay of the electro-optical modulation device from the plurality of color signals based on quantities of intensity variation in the plurality of color signals, the quantities of intensity variation in the plurality of color signals being obtained by integrating absolute values of the quantities of intensity variation in the respective color signals; and a light modulation section for modulating light emitted from the light source in the single frame in accordance with the information relating to the delay of the electro-optical modulation device.

* * * * *